US007920808B2

(12) United States Patent
Ohkushi et al.

(10) Patent No.: US 7,920,808 B2
(45) Date of Patent: Apr. 5, 2011

(54) BELT DEVICE AND IMAGE-FORMING APPARATUS

(75) Inventors: Hirofumi Ohkushi, Ibaraki (JP); Yuichi Hirose, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 338 days.

(21) Appl. No.: 12/199,029

(22) Filed: Aug. 27, 2008

(65) Prior Publication Data

US 2009/0060605 A1 Mar. 5, 2009

(30) Foreign Application Priority Data

Aug. 31, 2007 (JP) ..... 2007-226027
May 19, 2008 (JP) ..... 2008-130280

(51) Int. Cl.
*G03G 15/08* (2006.01)

(52) U.S. Cl. ..... 399/121

(58) Field of Classification Search ..... 399/121, 399/162, 278, 288, 302, 308, 312, 313, 329; 198/860.1

See application file for complete search history.

(56) References Cited

U.S. PATENT DOCUMENTS 5,669,054 A * 9/1997 Uchida et al. ..... 399/313
7,369,793 B2 * 5/2008 Kumazawa ..... 399/121
7,509,073 B2 * 3/2009 Katoh et al. ..... 399/121
7,577,381 B2 * 8/2009 Takuwa ..... 399/121
7,609,997 B2 * 10/2009 Otake et al. ..... 399/121
7,693,452 B2 * 4/2010 Kaiho et al. ..... 399/121
2004/0228653 A1 * 11/2004 Yoshino ..... 399/121
2005/0169667 A1 8/2005 Katoh
2006/0045570 A1 * 3/2006 Kato et al. ..... 399/121
2006/0193656 A1 8/2006 Kumazawa
2007/0048005 A1 3/2007 Nakano et al.

FOREIGN PATENT DOCUMENTS

JP 60097380 A * 5/1985
JP 2004-341087 12/2004
JP 2005-134763 5/2005
JP 2006201352 A * 8/2006
JP 4125010 5/2008

OTHER PUBLICATIONS

U.S. Appl. No. 12/125,519, filed May 22, 2008, Toshiyuki Andoh et al.

* cited by examiner

*Primary Examiner* — Robert Beatty
(74) *Attorney, Agent, or Firm* — Oblon, Spivak, McClelland, Maier & Neustadt, L.L.P.

(57) ABSTRACT

A belt device for use in an image forming apparatus includes two side frames supported by two slide rails disposed at the body of the image forming apparatus on the outside of the outer periphery of the belt member, a rear frame constructed between two sub-frames and having a box-shaped structure, a front frame having a smaller projecting surface than the inner periphery of the belt member as viewed from the front, a support frame that cantilever-supports the front frame with respect to the rear frame, and triangular reinforcing frames constructed across the side frames and the rear frame.

6 Claims, 19 Drawing Sheets

BELT DEVICE AND IMAGE-FORMING APPARATUS

CROSS-REFERENCE TO RELATED APPLICATIONS

The present application claims priority to and incorporates by reference the entire contents of Japanese priority document 2007-226027 filed in Japan on Aug. 31, 2007 and Japanese priority document 2008-130280 filed in Japan on May 19, 2008.

BACKGROUND OF THE INVENTION

1. Field of the Invention

The present invention relates to a belt device for use in an image forming apparatus.

2. Description of the Related Art

Tandem color image forming apparatuses, such as copiers and printers, including an intermediate transfer belt (belt device) are well-known in the art. Such image forming apparatuses have been disclosed in, for example, Japanese Patent Application Laid-open No. 2004-341087 and Japanese Patent No. 3473148.

In a typical image forming apparatus, four photosensitive drums (image carriers) are provided side by side facing an intermediate transfer belt (belt member). Single-color toner images for black, yellow, magenta, and cyan are respectively formed on each of the four photosensitive drums. Those single-color toner images are then transferred so as to be overlaid on top of each other on the intermediate transfer belt to form a color toner image on the intermediate transfer belt. The color toner image supported on the intermediate transfer belt is then transferred to and fixed on a recording medium, such as a paper, as a color image.

Configurations where an intermediate transfer belt device can be pulled out to the front with respect to an image forming apparatus body are common. Such a configuration makes maintenance of the intermediate transfer belt device straightforward. Specifically, in Japanese Patent Application Laid-open No. 2004-341087, a transfer module fitted with an intermediate transfer belt is mounted on an intermediate transfer belt device. After then pulling the intermediate transfer belt device (transfer unit) to the front with respect to the image forming apparatus body, the transfer module mounted on the intermediate transfer belt device can be detached from above.

With the image forming apparatus of Japanese Patent Application Laid-open No. 2004-341087, it is necessary for the transfer module mounted on the intermediate transfer belt apparatus to be detached upwards after the intermediate transfer belt device (belt device) is pulled out to the front with respect to the image forming apparatus body while changing the intermediate transfer belt (belt member). However, in this configuration, ease of maintenance (maintenance operativity) of the intermediate transfer belt device, such as changing of the intermediate transfer belt, drops.

In order to resolve this situation, it is therefore preferable to ensure that maintenance of the intermediate transfer belt device is possible in a state where the intermediate transfer belt device is pulled out to the front with respect to the image forming apparatus body. This can, however, cause a frame of the intermediate transfer belt device to deform as a result of the intermediate transfer belt device being pulled out with respect to the image forming apparatus body for a long period of time. Deformation of the frame of the intermediate transfer belt device can lead to misalignment of various components mounted on the frame and can cause degradation of image quality. This problem is particularly difficult to ignore in large image forming apparatus where the weight of the intermediate transfer belt apparatus is substantial. The outer periphery of the intermediate transfer belt of conventional apparatus is substantially covered by a frame. It is therefore not possible to change the intermediate transfer belt with a single action in a state where the intermediate transfer belt device is pulled out to the front with respect to the image forming apparatus body.

SUMMARY OF THE INVENTION

It is an object of the present invention to at least partially solve the problems in the conventional technology.

According to an aspect of the present invention, there is provided a belt device for use in an image forming apparatus such that the belt device can be pulled out to the front with respect to a body of the image forming apparatus. The belt device includes an endless belt member supported at a plurality of roller members so as to travel in a predetermined direction; two side frames disposed along sides of the belt member in the direction of travel of the belt member, the side frames being respectively slidably supported at two slide rails disposed at the body; a rear frame constructed to the rear across the two side frames, rotatably supporting shafts of the roller members at the rear side, and having a box-type structure; a front frame rotatably supporting shafts of the roller members on the front side, and having a projecting surface smaller than an inner periphery of the belt member when viewed from the front; a support frame cantilever-supporting the front frame with respect to the rear frame; and triangular reinforcing members constructed across both the side frames and the rear frame near joints of the side frames and the rear frame.

According to another aspect of the present invention, there is provided a belt device for use in an image forming apparatus such that the belt device can be pulled out to the front with respect to a body of the image forming apparatus. The belt device includes an endless belt member supported at a plurality of roller members so as to travel in a predetermined direction; a plurality of side frames disposed along sides of the belt member in the direction of travel of the belt member, the side frames being respectively slidably supported at a plurality of slide rails disposed at the body; a rear frame constructed across the side frames, rotatably supporting shafts of the roller members at the rear side; a front frame rotatably supporting the shafts of the roller members at the front side, and having a projecting surface smaller than an inner periphery of the belt member when viewed from a pulling out direction; and a support frame cantilever-supporting the front frame with respect to the rear frame.

According to still another aspect of the present invention, there is provided a belt device for use in an image forming apparatus such that the belt device can be pulled out to the front with respect to a body of the image forming apparatus. The belt device includes an endless belt member supported at a plurality of roller members so as to travel in a predetermined direction; a rear frame comprising a freely detachable holding member supporting rear side bearings that support the rear side shafts of the roller members in a freely rotatable manner, and a sub-bearing having a larger internal diameter than an outer diameter of the rear side shaft section of the roller member more to a center side in an axial direction than a position of the rear side bearing; and a front frame comprising front-side bearings supporting the front side shafts of the roller member in a freely rotatable manner.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
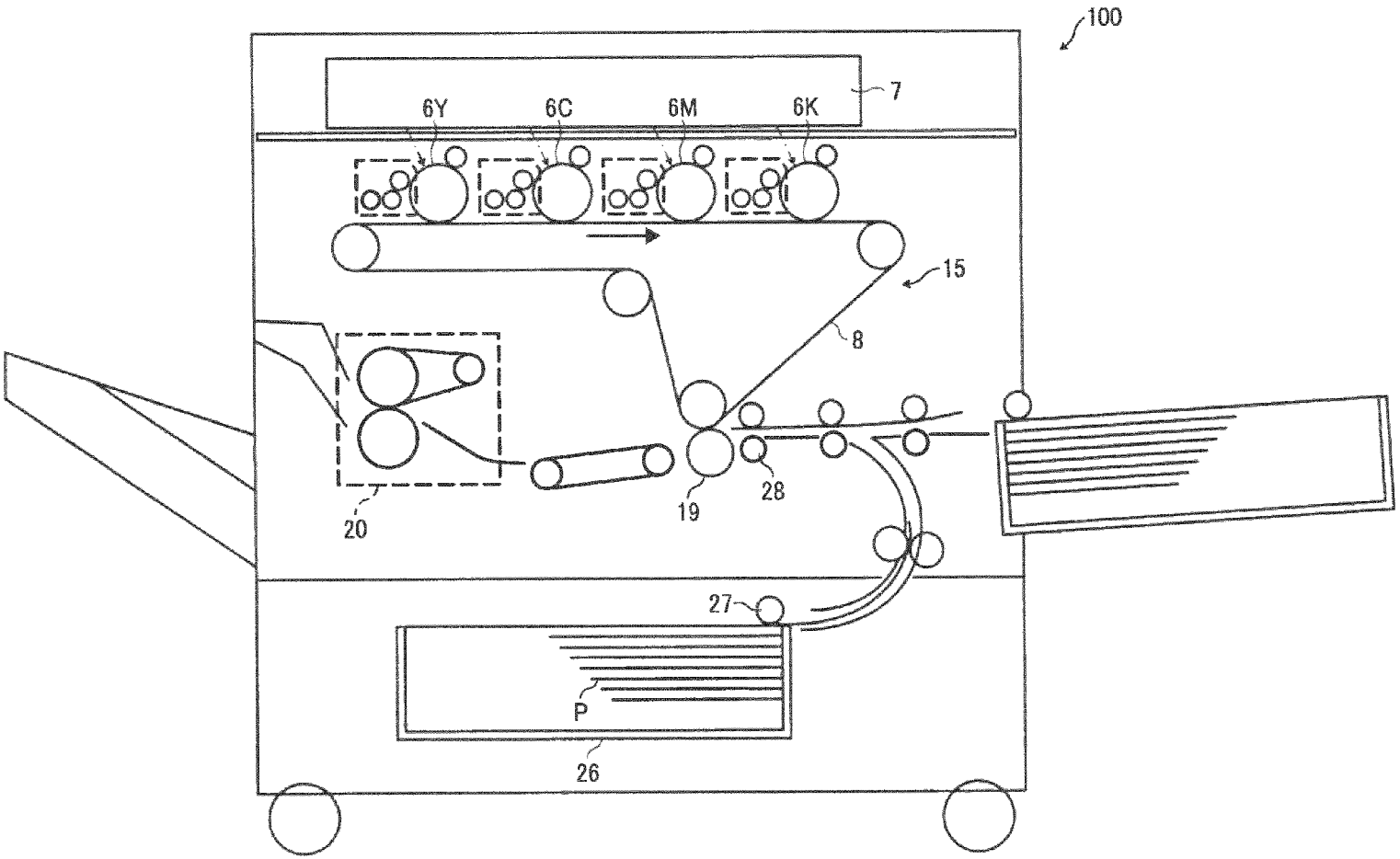
FIG. 1 is a schematic side view of an image forming apparatus according to a first embodiment of the present invention.

Exemplary embodiments of the present invention are explained in detail in the following with reference to the drawings. Corresponding or identical portions in the drawings are given the same numerals, with duplicate explanations being simplified or omitted as appropriate.

In this application, "to the front" is defined as the side to which the belt device is pulled outwards with respect to the image forming apparatus body (side to the front side of the pulling out direction). Further, "to the rear" is the opposite side to "to the front" and is defined as a direction of pulling out the belt device to the back. "Widthwise direction" is defined as a horizontal direction orthogonal to the pulling-out direction.

A first embodiment of the present invention is explained in detail below with reference to FIGS. 1 to 15.

Figure 2:
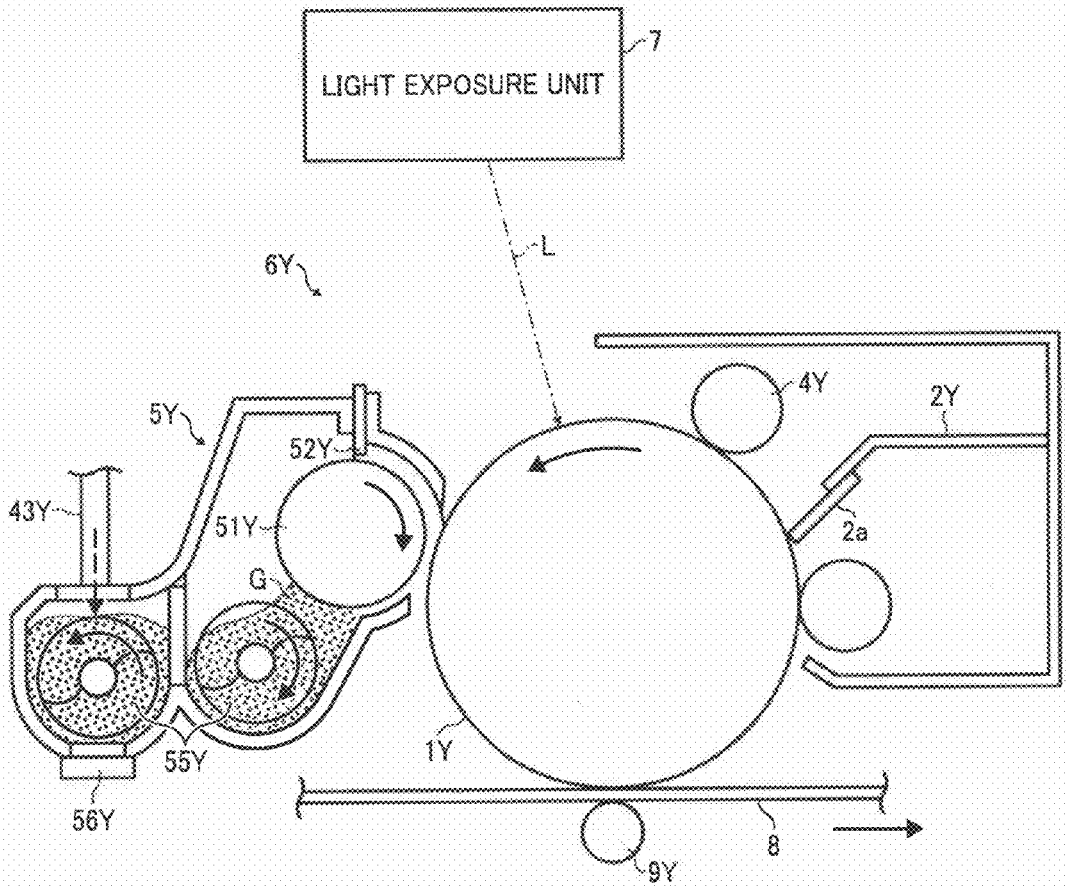
FIG. 2 is a schematic side view of an image-forming unit corresponding to yellow shown in FIG. 1.

First, an overall structure and operation of an image forming apparatus is explained with reference to FIGS. 1 and 2. FIG. 1 is a side view of a printer as an image forming apparatus, and FIG. 2 is schematic view of an image-forming unit corresponding to yellow shown in FIG. 1. As shown in FIG. 1, an intermediate transfer belt device 15 is disposed as a belt device at the center of an image forming apparatus body 100. Operation units 6Y, 6M, 6C, 6K corresponding to yellow, magenta, cyan, black, respectively, are then disposed next to each other facing an intermediate transfer belt 8 (belt member) of the intermediate transfer belt device 15.

As shown in FIG. 2, the operation unit 6Y corresponding to yellow includes a photosensitive drum 1Y as an image carrier, an electrostatic charging unit 4Y disposed at the periphery of the photosensitive drum 1Y, a developing unit 5Y, a cleaning unit 2Y, and a charge removal unit (not shown). A developing process (charging, exposure, developing, transfer, and cleaning) is carried out on the photosensitive drum 1Y. As a result, a yellow image is formed on the photosensitive drum 1Y.

With the exception of the color of the toner used being different, the remaining three operation units 6M, 6C, 6K have substantially the same structure as the operation unit 6Y for yellow and form images corresponding to the respective toner colors. In the following, a description is given only of the operation unit 6Y, with descriptions of the remaining three operation units 6M, 6C, 6K being omitted as appropriate.

Referring to FIG. 2, the photosensitive drum 1Y is rotated in an anti-clockwise direction by a drive motor (not shown). The surface of the photosensitive drum 1Y is uniformly charged at the position of the electrostatic charging unit 4Y (charging). After this, the charged surface of the photosensitive drum 1Y reaches an irradiation position of laser light L emitted from a light exposure unit 7. A latent image corresponding to yellow is then formed by exposure scanning at this position (exposing).

The latent-image formed surface of the photosensitive drum 1Y then reaches a position corresponding to the developing unit 5Y. A latent image is developed at this position and a yellow toner image is formed (developing). The toner-image formed surface of the photosensitive drum 1Y then reaches a position corresponding to the intermediate transfer belt 8 (belt member) and the transfer roller 9Y (primary transfer roller). A toner image on the photosensitive drum 1Y is then transferred onto the intermediate transfer belt 8 at this position (primary transfer). A small amount of un-transferred toner may remain on the photosensitive drum 1Y at this time.

The surface of the photosensitive drum 1Y then reaches a position corresponding to the cleaning unit 2Y. Un-transferred toner remaining on the photosensitive drum 1Y at this position is then recovered to within the cleaning unit 2Y by a cleaning blade 2*a* (cleaning). Finally, the surface of the photosensitive drum 1Y reaches a position corresponding to the charge removal unit (not shown). Residual potential on the photosensitive drum 1Y is then completely removed at this position. This completes a series of development processes carried out on the photosensitive drum 1Y.

The development processes for the operation units 6M, 6C, 6K are the same as for the yellow operation unit 6Y. Laser light L based on image information is irradiated from the light exposure unit 7 disposed above the operation unit towards photosensitive drums 1M, 1C, 1K of each operation unit 6M, 6C, 6K. The light exposure unit 7 emits the laser light L from a light source and irradiates the photosensitive drum with the laser light L via a plurality of optical elements while scanning with the laser light using a rotating polygon mirror. Toner images for each color formed on each photosensitive drum via the developing step are then overlaid and transferred onto the intermediate transfer belt 8 thereby forming a full color image on the intermediate transfer belt 8.

Figure 3:
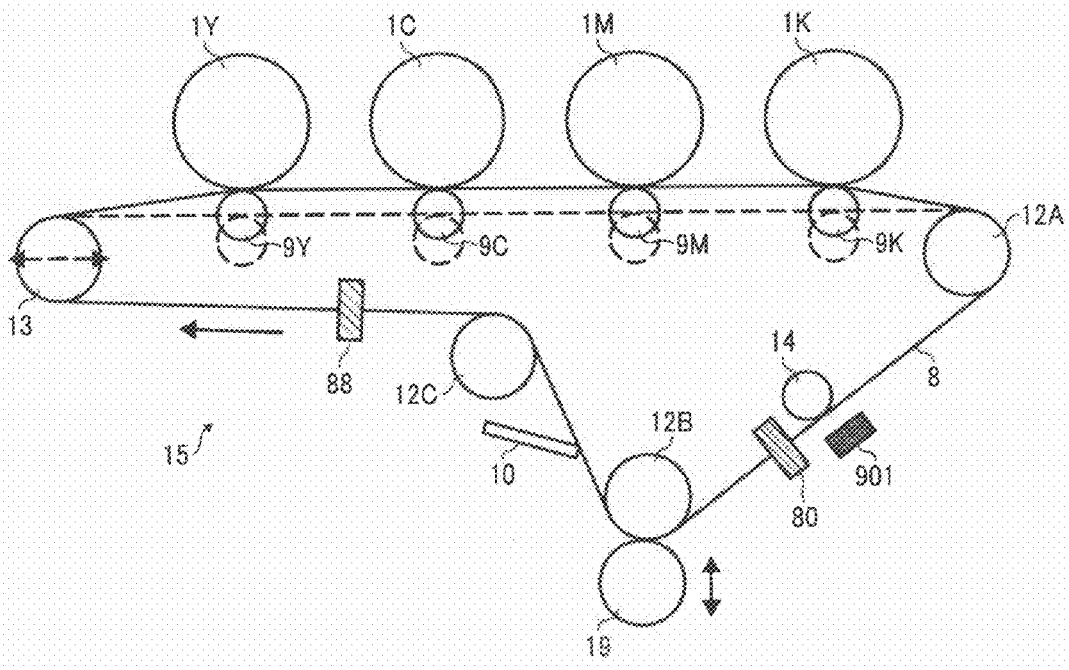
FIG. 3 is a schematic view of a belt device shown in FIG. 1.

As shown in FIG. 3, the intermediate transfer belt device 15 (belt device) includes the intermediate transfer belt 8, four transfer rollers 9Y, 9M, 9C, and 9K, a drive roller 12A, a tension roller 12B, a tension roller 12C, a correction roller 13 (correcting unit), a movable secondary transfer roller 19, a restricting roller 14, a meandering detecting unit 80 (detecting unit), an abnormality detecting unit 88, a photosensor 901, and an intermediate transfer cleaning unit 10. The intermediate transfer belt 8 is an endless belt that spans across in a tensioned manner, is supported by the roller members 12A to 12C, 13, and 14 and is driven by drive force of one roller member, i.e., the drive roller 12A, in the clockwise direction, i.e., the direction of an arrow in FIG. 3.

The four transfer rollers 9Y, 9M, 9C, and 9K (primary transfer rollers) form a primary transfer nip by sandwiching the intermediate transfer belt 8 together with the photosensitive drums 1Y, 1M, 1C, and 1K. A transfer voltage (transfer bias) of a polarity opposite to the toner polarity is then applied to the transfer rollers 9Y, 9M, 9C, and 9K. The intermediate transfer belt 8 then travels in the clockwise direction and sequentially passes through the primary transfer nip of the transfer rollers 9Y, 9M, 9C, and 9K. Toner images for each of the colors on the photosensitive drums 1Y, 1M, 1C, and 1K then undergo primary transfer so as to be overlaid on the intermediate transfer belt 8.

After this, the toner images on the intermediate transfer belt 8 reach a position facing the secondary transfer roller 19. At this position, the tension roller 12B sandwiches the intermediate transfer belt 8 together with the secondary transfer roller 19 so as to form a secondary transfer nip. A transfer voltage (secondary transfer bias) of a polarity opposite to the toner polarity is then applied to the secondary transfer roller 19. As a result, the toner images on the intermediate transfer belt 8 are transferred onto a recording medium P such as transfer paper conveyed to the position of the secondary transfer nip. At this time, un-transferred toner that was not transferred to the recording medium P may remain on the intermediate transfer belt 8.

After this, the intermediate transfer belt 8 reaches the position of the intermediate transfer cleaning unit 10. Un-transferred toner on the intermediate transfer belt 8 is then removed at this position. This completes the series of transfer processes taking place on the intermediate transfer belt 8. The structure and operation of the intermediate transfer belt device 15 taken as a belt device are now explained in detail using FIGS. 3 to 15.

Referring to FIG. 1, a paper feeding unit 26 is disposed at the bottom of the image forming apparatus body 100. Paper feeding rollers 27 and registration rollers 28 pick-up one blank recording medium P from the paper feeding unit 26 and convey it to the position of the secondary transfer nip. An additional paper feeding unit can be disposed at a side of the image forming apparatus body 100. Specifically, a plurality of recording media P such as paper sheets are housed one on top of another at the paper feeding unit 26. When the paper feeding rollers 27 rotate in an anti-clockwise direction, an uppermost recording medium P is fed in a direction to between the registration rollers 28.

The recording medium P conveyed to the registration rollers 28 is then temporarily stopped at the position of a roller nip of the registration rollers 28 for which rotation has stopped. The registration rollers 28 are then rotated in line with the timing of a color image on the intermediate transfer belt 8 and the recording medium P is conveyed in the direction of the secondary transfer nip. An image of the desired color is therefore transferred onto the recording medium P.

After this, the recording medium P to which the color image is transferred to at the position of the secondary transfer nip is conveyed to the position of a fixing unit 20. In the fixing unit 20 the color image transferred to the surface is fixed onto the recording medium P using heat and pressure of a fixing roller and a pressure roller. The recording medium P is then discharged to outside of the device by a pair of paper ejection rollers (not shown). The recording media P subjected to transfer is discharged to outside of the device by the paper ejection rollers is then sequentially stacked on a stack unit as output images. The series of image-forming processes occurring at the image forming apparatus body 100 are then complete.

Next, a detailed description is given of the structure and operation of the developing unit 5Y. The developing unit 5Y includes a developing roller 51Y facing the photosensitive drum 1Y, a doctor blade 52Y facing the developing roller 51Y, two conveyor screws 55Y disposed within a developer container, a toner supply path 43Y communicating via an opening at the developer container, and a density detection sensor 56 that detects toner density within the developer. The developing roller 51Y includes a magnet installed inside and a sleeve rotating the periphery of the magnet. A two-component developer composed of a carrier and a toner is housed within the developer container.

The developing unit 5Y operates as follows. The sleeve of the developing roller 51Y rotates in the direction of the arrow of FIG. 2. Developer supported on the developing roller 51Y, due to the magnetic field generated by the magnet installed inside and the sleeve, moves on the developing roller 51Y in accompaniment with rotation of the sleeve. Developer within the developing unit 5Y is adjusted so that a proportion of toner within the developer, i.e., the toner density, is within a predetermined range. The toner supplied to within the developer container is then circulated in two isolated developer containers while being mixed and agitated together with the developer by the two conveyor screws 55Y (movement in a direction perpendicular to the paper in FIG. 2). The toner in the developer is then absorbed by the carrier as a result of frictional electrification with the carrier and is supported on the developing roller 51Y together with the carrier due to magnetic force present at the developing roller 51Y.

The developer supported on the developing roller 51Y is conveyed in the direction of the arrow of FIG. 2 and reaches the position of the doctor blade 52Y. The developer on the developing roller 51Y is then conveyed as far as a position (developing region) facing the photosensitive drum 1Y after the amount of developer is optimized at this position. The toner is then absorbed at the latent image formed on the photosensitive drum 1Y by the electric field formed at the developing region. The developer remaining on the developing roller 51Y then reaches the upper part of the developer container in accompaniment with rotation of the sleeve and the developing roller 51Y is then separated at this position.

Figure 4:
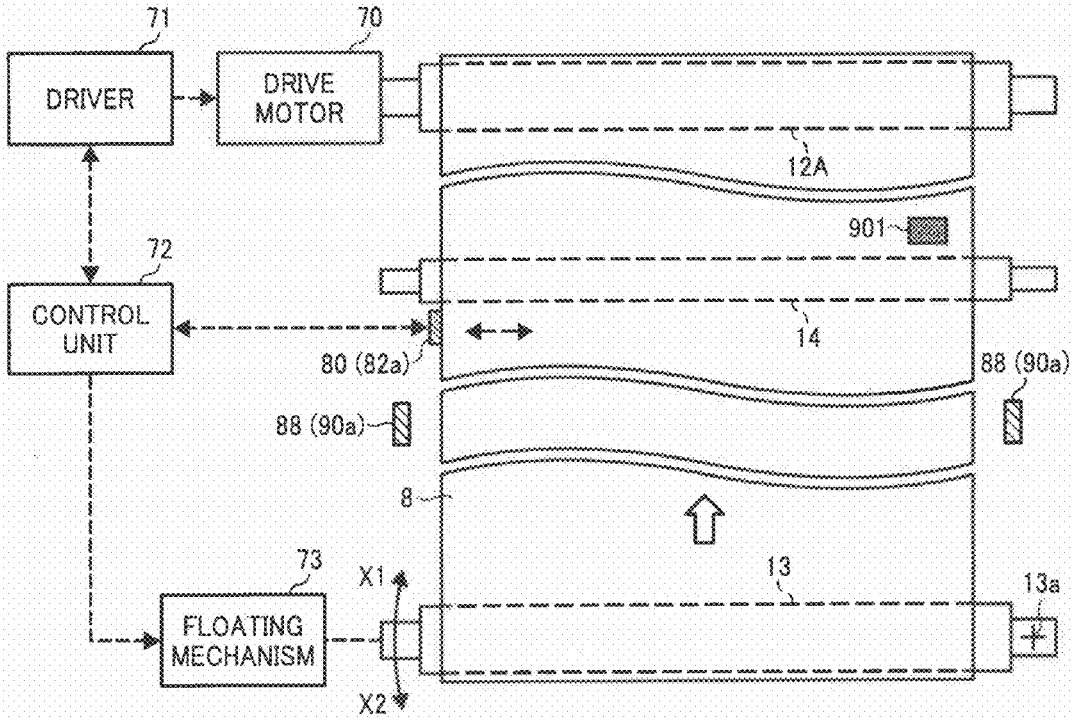
FIG. 4 is a schematic plane view of a part of the belt device shown in FIG. 3.
Figure 5:
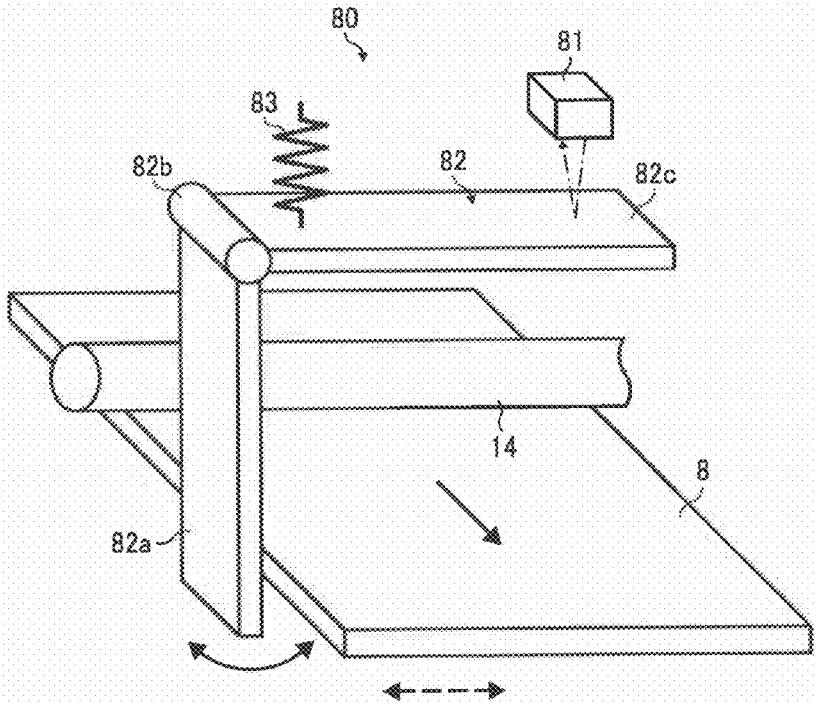
FIG. 5 is a perspective view of a meandering detecting unit shown in FIG. 4.
Figure 6:
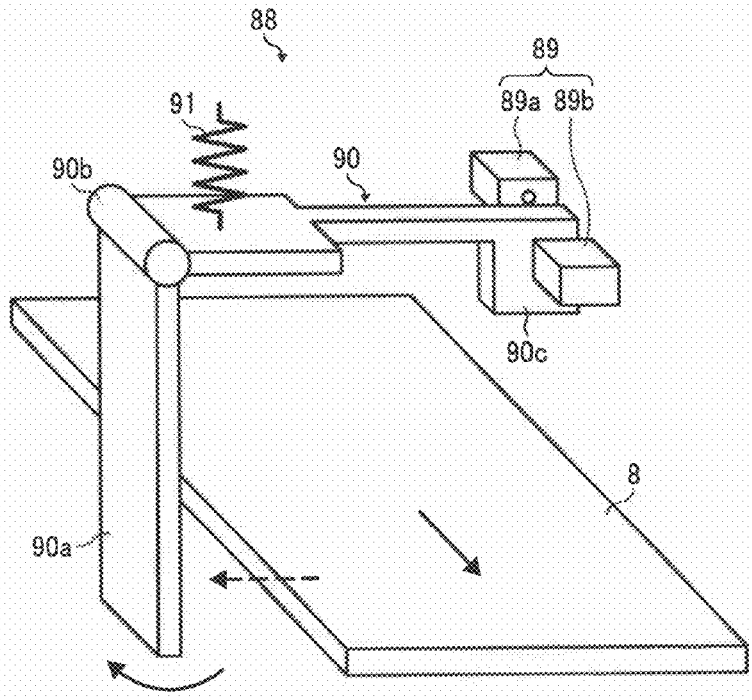
FIG. 6 is a perspective view of an abnormality detecting unit shown in FIG. 4.

Next, the intermediate transfer belt device 15 (belt device) of this embodiment is explained referring to FIGS. 3 to 15. FIG. 3 is a schematic diagram showing the intermediate transfer belt device 15. FIG. 4 is a schematic plane view of a part of the intermediate transfer belt device 15. FIG. 5 is a perspective view showing the vicinity of the meandering detecting unit 80 shown in FIG. 4. FIG. 6 is a perspective view showing the vicinity of the abnormality detecting unit 88 shown in FIG. 4.

Referring to FIGS. 3 and 4, the intermediate transfer belt device 15 includes the intermediate transfer belt 8 that is the belt member, the four transfer rollers 9Y, 9M, 9C, and 9K, the drive roller 12A, the tension roller 12B and the tension roller 12C, the correction roller 13 as a detecting unit, the restricting roller 14, the meandering detecting unit 80 as a detecting unit, the abnormality detecting unit 88, the photosensor 901, and the intermediate transfer cleaning unit 10.

The intermediate transfer belt 8 taken as a belt member is disposed facing the photosensitive drums 1Y, 1M, 1C, and 1K taken as four image carriers supporting toner images for each color. The intermediate transfer belt 8 is supported in a tensioned manner mainly on five roller members, i.e., the drive roller 12A, the tension roller 12B, the tension roller 12C, the correction roller 13, and the restricting roller 14.

The intermediate transfer belt 8 can be formed from one or a plurality of layers of PVDF (polyvinylidene fluoride), ETFE (ethylene tetrafluoroethylene), PI (polyamide), or PC (polycarbonate) etc. dispersed in a conductive material such as carbon black. The intermediate transfer belt 8 is adjusted to have a volume resistivity of $10^7$ ohm/cm to $10^{12}$ ohm/cm, and the surface resistivity of the rear surface side of the belt is adjusted to the range of $10^8$ ohm/cm to $10^{12}$ ohm/cm. The intermediate transfer belt 8 can have a thickness in the range of 80 micrometers to 100 micrometers. In this embodiment, a 90-micrometer thick and 2197.5-millimeter long intermediate transfer belt 8 was used. The surface of the intermediate transfer belt 8 can be coated with a separating layer as necessary. During this time, a fluororesin such as ETFE (ethylene tetrafluoroethylene), PTFE (polytetrafluoroethylene), PVDF (polyvinylidene fluoride), PEA (perfluoroalkoxy), FEP (fluorinated ethyl propylene copolymer), or PVF (polyvinyl fluoride) is used but this is not limiting. The method for manufacturing the intermediate transfer belt 8 can be an injection method or a centrifugal forming method etc. with the surface being polished as necessary.

The transfer rollers 9Y, 9M, 9C, and 9K face the corresponding photosensitive drums 1Y, 1M, 1C, and 1K with the intermediate transfer belt 8 therebetween. Specifically, the yellow transfer roller 9Y faces the yellow photosensitive drum 1Y with the intermediate transfer belt 8 therebetween, the magenta transfer roller 9M faces the magenta photosensitive drum 1M with the intermediate transfer belt 8 therebetween, the cyan transfer roller 9C faces the cyan photosensitive drum 1C with the intermediate transfer belt 8 therebetween, and the black transfer roller 9K faces the photosensitive drum 1C with the intermediate transfer belt 8 therebetween.

Figure 7:
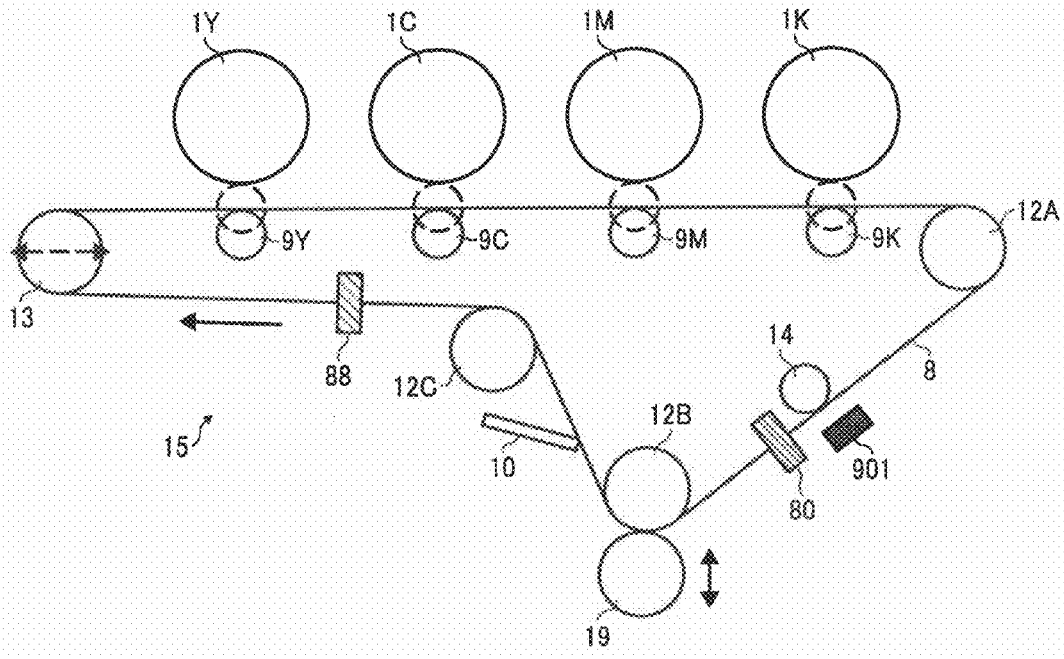
FIG. 7 depicts a state of the belt device shown in FIG. 3 where the an intermediate transfer belt is separated from photosensitive drums.
Figure 8:
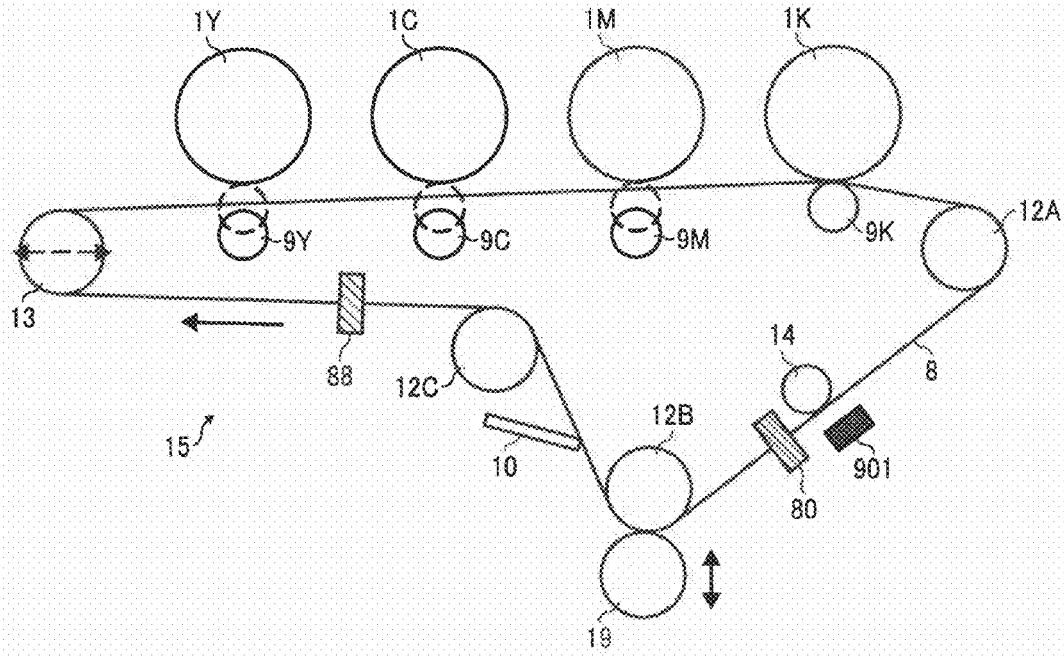
FIG. 8 is depicts a state of the belt device shown in FIG. 3 in case of a black-image formation mode.

The four transfer rollers 9Y, 9M, 9C, and 9K are configured so that they can separate the intermediate transfer belt 8 from the photosensitive drums 1Y, 1M, 1C, and 1K. Specifically, the three transfer rollers 9Y, 9M, and 9C for color use out of the four transfer rollers 9Y, 9M, 9C, and 9K are integrally supported at a holding member (not shown) and are capable of being moved integrally in a vertical direction. The black transfer roller 9K can also be independently moved vertically. As shown in FIG. 7, the intermediate transfer belt 8 can be separated from the photosensitive drums 1Y, 1M, 1C, and 1K (moved to the position of the dashed line) by moving the four transfer rollers 9Y, 9M, 9C, and 9K to the position of the dashed line in FIG. 3. The operation of separating the intermediate transfer belt 8 from the photosensitive drums 1Y, 1M, 1C, and 1K is performed in order to reduce wear on the intermediate transfer belt 8 and is therefore mainly performed when image-forming is not taking place. The structure is which the black transfer roller 9K can be moved independent of the transfer rollers 9Y, 9M, 9C for color use is adapted as shown in FIG. 8 so that the black transfer roller 9K can be moved and separated from the intermediate transfer belt 8 when not forming a black image.

In the first embodiment, when a color-image formation mode (a mode for forming a color image) is selected, by a contact/noncontact structure, an intermediate transfer belt 8 is made to came in contact with all of the four photosensitive drums 1Y, 1M, 1C, and 1K (the state shown in FIG. 3). On the contrary, when a black-image formation mode (a mode for forming a black image) is selected, by the contact/noncontact structure, the intermediate transfer belt 8 is made to came in contact with only the photosensitive drum 1K, i.e., the other three photosensitive drums 1Y, 1M, and 1C are separated from the intermediate transfer belt 8 (the state shown in FIG. 8).

The drive roller 12A is rotated by a drive motor 70. This causes the intermediate transfer belt 8 to advance a predetermined extent in the direction of travel (clockwise direction of FIG. 3). The drive motor 70 is a stepping motor operated by a drive signal (pulse signal) from a driver 71 controlled by a control unit 72. The tension roller 12B abuts with the secondary transfer roller 19 via the intermediate transfer belt 8. The tension roller 12C abuts with the outer peripheral surface of the intermediate transfer belt 8. The intermediate transfer cleaning unit 10 (cleaning blade) is disposed between the tension rollers 12B and 12C.

The meandering detecting unit 80 detects displacement of the intermediate transfer belt 8 in a widthwise direction (direction perpendicular to the paper of FIG. 3). Referring to FIG. 5, the meandering detecting unit 80 includes an L-shaped reciprocating member 82 abutting with the side of the intermediate transfer belt 8, a distance sensor 81 that detects the extent of displacement of the reciprocating member 82, and a spring 83 that urges the reciprocating member 82 in a direction of abutment with the intermediate transfer belt 8.

The reciprocating member 82 includes a first arm section 82*a*, a rotating support shaft 82*b*, and a second arm section 82*c*. An end of the first arm section 82*a* abuts with the side of the intermediate transfer belt 8 and the other end is fixed to the rotating support shaft 82*b*. The rotating support shaft 82*b* is supported in a freely rotating manner at a casing (not shown) of the intermediate transfer belt device 15. An end of the second arm section 82*c* is fixed to the rotating support shaft 82*b*. An end of the spring 83 is connected to the center of the second arm section 82*c*. The other end of the spring 83 is connected to the casing. The reciprocating member 82 reciprocates (reciprocation in the direction of the double-headed arrow in FIG. 5) in accordance with displacement of the intermediate transfer belt 8 in the direction of the dashed line double-headed arrow in FIG. 5 as the intermediate transfer belt 8 travels in the direction of the single-headed arrow in FIG. 5. In the first embodiment, the intermediate transfer belt 8 is set to travel at a speed of 440 mm/s in normal time in the direction of travel (direction of an arrow in FIG. 5).

The distance sensor 81 is installed at the upper part of the other end of the second arm section 82*c*. The distance sensor 81 mainly includes light-emitting elements (infra-red light-emitting diodes) disposed next to each other spaced across the horizontal direction and a position sensing detector (PSD). Infra-red light emitted from the light-emitting elements is reflected by the surface of the second arm section 82*c* so as to be incident to the position detecting elements as reflected light. A position of incidence of the reflected light incident to the position detecting elements changes with a change in the distance between the distance sensor 81 and the second arm section 82*c*. An output value of the distance sensor 81 then changes in proportion to this. It is therefore possible to detect an extent of displacement, i.e., the distance to the surface of the second arm section 82*c*, of the intermediate transfer belt 8 in a widthwise direction. When a distance detected by the distance sensor 81 is larger than a predetermined value, i.e., when the output value (voltage) of the distance sensor 81 is larger than a predetermined value, it means that the intermediate transfer belt 8 is displaced in the plus direction (position shift to the left side of FIG. 5) with regards to a target position. On the contrary, when the distance detected by the distance sensor 81 is smaller than a predetermined value, i.e., when the output value (voltage) of the distance sensor 81 is smaller than a predetermined value, it means that the intermediate transfer belt 8 is displaced in the minus direction (position shift to the right side of FIG. 5) with respect to the target position.

In the first embodiment, the meandering detecting unit 80 detects (abnormal detection) abnormal belt bias during normal image-forming (during printing) etc. Belt position shift correction is then performed by the correction roller 13 based on the detection results of the meandering detecting unit 80 taking a belt bias (position shift) of plus or minus 0.5 millimeters (mm) with respect to a reference position (i.e., when the position shift is 0 mm) as a permitted range (permitted print range). When the belt bias (position shift) of the intermediate transfer belt 8 goes outside a detection range (plus or minus 1 mm) of the meandering detecting unit 80, it means that a comparatively large belt bias has occurred. In that case the device is therefore forcibly stopped and an abnormality detection is displayed at a display unit (not shown) of the image forming apparatus body 100. Abnormality detection is also performed by the abnormality detecting unit 88 in addition to the abnormality detection performed by the meandering detecting unit 80. This duplication of the detection of abnormalities for belt bias is carried out so that abnormality detection is reliably carried out even if the meandering detecting unit 80 is damaged or runaway of the control software occurs.

The restricting roller 14 restricts the displacement of the intermediate transfer belt 8 in a direction perpendicular to the surface of the intermediate transfer belt 8. The restricting roller 14 is disposed near to the meandering detecting unit 80. Specifically, the restricting roller 14 is near and on an upstream side in the direction of travel of the intermediate transfer belt 8 with respect to the abutting position of the first arm section 82*a* and the intermediate transfer belt 8. With the above structure, displacement (runout) of the intermediate transfer belt 8 in a direction perpendicular to surface of the intermediate transfer belt 8 near the meandering detecting unit 80 is alleviated. Namely, because the restricting roller 14 restricts displacement of the intermediate transfer belt 8 by applying tension to the intermediate transfer belt 8, displacement of the reciprocating member 82 in a direction perpendicular to the surface of the intermediate transfer belt 8 is also restricted. As a result, the inconvenience of detecting a displacement component for different directions to the widthwise direction and the direction of travel can be reduced. Namely, the detection precision can be improved.

If the meandering detecting unit 80 detects displacement of the intermediate transfer belt 8, the correction roller 13 (meandering correction mechanism) is used to correct the displacement. Referring to FIG. 3, the correction roller 13 is disposed upstream in a direction of travel of the intermediate transfer belt 8 with respect to the photosensitive drums 1Y, 1M, 1C, and 1K and makes contact with the inner surface of the intermediate transfer belt 8. Referring to FIGS. 4 and 6, the correction roller 13 reciprocates in directions X1 and X2 (up and down) taking a center of reciprocation 13*a* as center as a result of the drive cam (not shown) of a floating mechanism 73 shifting at predetermined angle. When the intermediate transfer belt 8 is displaced to the right side (as viewed from the belt) in FIG. 4, the correction roller 13 is caused to reciprocate in the X2 direction by the floating mechanism 73 so as to correct displacement of the intermediate transfer belt 8. On the contrary, when the intermediate transfer belt 8 is displaced to the left side in FIG. 4, the correction roller 13 is caused to reciprocate in the direction X1 by the floating mechanism 73 so as to carry out displacement correction of the intermediate transfer belt 8. This makes it possible to prevent the intermediate transfer belt 8 from meandering or the intermediate transfer belt 8 from becoming damaged as a result of being displaced substantially in a widthwise direction (towards the belt) so as to come into contact with other members.

Referring to FIG. 6, in the intermediate transfer belt device 15, the abnormality detecting unit 88 is disposed at a position spaced a prescribed distance from the ends of the intermediate transfer belt 8 in a widthwise direction. The abnormality detecting unit 88 includes an arm member 90 making contact with a side of the intermediate transfer belt 8 when there is substantial belt bias, an over-run detection sensor 89 (optical sensor) that optically detects movement taking a rotating spindle 90*b* of the arm member 90 as center using contact of the intermediate transfer belt 8, and a spring 91 for maintaining the posture of the arm member 90.

The arm member 90 includes a first arm section 90*a*, the rotating spindle 90*b*, and a second arm section 90*c*. One end of the first arm section 90*a* is set at a position 5 millimeters from the side of the intermediate transfer belt 8 that is in a normal position and the other end is fixed to at the rotating spindle 90*b*. The rotating spindle 90*b* is supported in a freely rotating manner at a casing (not shown) of the intermediate transfer belt device 15. An end of the second arm section 90*c* is fixed to the rotating spindle 90*b*, and the other end is set between a light-emitting unit 89*a* and a light-receiving unit 89*b* of the over-run detection sensor 89. An end of the spring 91 is connected to the center of the second arm section 90*c*. The other end of the spring 91 is connected to the casing. One end of the second arm section 90*c* abuts with a positioning section of the casing as a result of the urging force of the spring 91.

When a substantial belt bias exceeding 5 mm occurs at the intermediate transfer belt 8, the arm member 90 abuts with the intermediate transfer belt 8 and reciprocates (reciprocates in the direction of a solid line arrow in FIG. 6). This situation is then detected by the over-run detection sensor 89. This is to say that separating of an end of the second arm section 90*c* from between the light-emitting unit 89*a* and the light-receiving unit 89*b* is then recognized as a result of light emitted from the light-emitting unit 89*a* being received by the light-receiving unit 89*b*. When an abnormality is then detected by the abnormality detecting unit 88 (over-run detection sensor 89), driving of the intermediate transfer belt 8 (the drive roller 12A) is stopped. The driving of the photosensitive drums 1Y, 1M, 1C, and 1K and the driving of the secondary transfer roller 19 is also stopped. The operation of relatively separating the intermediate transfer belt 8 from the photosensitive drums 1Y, 1M, 1C, and 1K and from the secondary transfer roller 19 is then forcibly carried out. An instruction to call a member of the service staff is then displayed at a display unit of the image forming apparatus body 100 (display to the effect that it is necessary for a member of the service staff to carry out repairs). In the first embodiment, referring to FIG. 3, the secondary transfer roller 19 is able to move freely into contact with and away from the intermediate transfer belt 8 (move in the direction of the arrow).

Referring to FIGS. 3 and 4, the intermediate transfer belt device 15 is provided with the photosensor 901. The photosensor 901 detects the position and density of the toner images (batch pattern) supported at the intermediate transfer belt 8 and optimizes the image-producing conditions. Specifically, shifts in positions of toner images (batch patterns) for each color formed on the intermediate transfer belt 8 via the image-forming processes are optically detected by the photosensor 901. The timing of the exposure of each of the photosensitive drums 1Y, 1M, 1C, and 1K by the light exposure unit 7 is then adjusted based on the detection results. The density (toner density) of toner images (batch patterns) formed on the intermediate transfer belt 8 via the image-forming processes is optically detected by the photosensor 901. The toner density of the developer housed in the developing unit 5Y (and developing units 5C, 5M, and 5K) is then adjusted based on the detection results.

Figure 9:
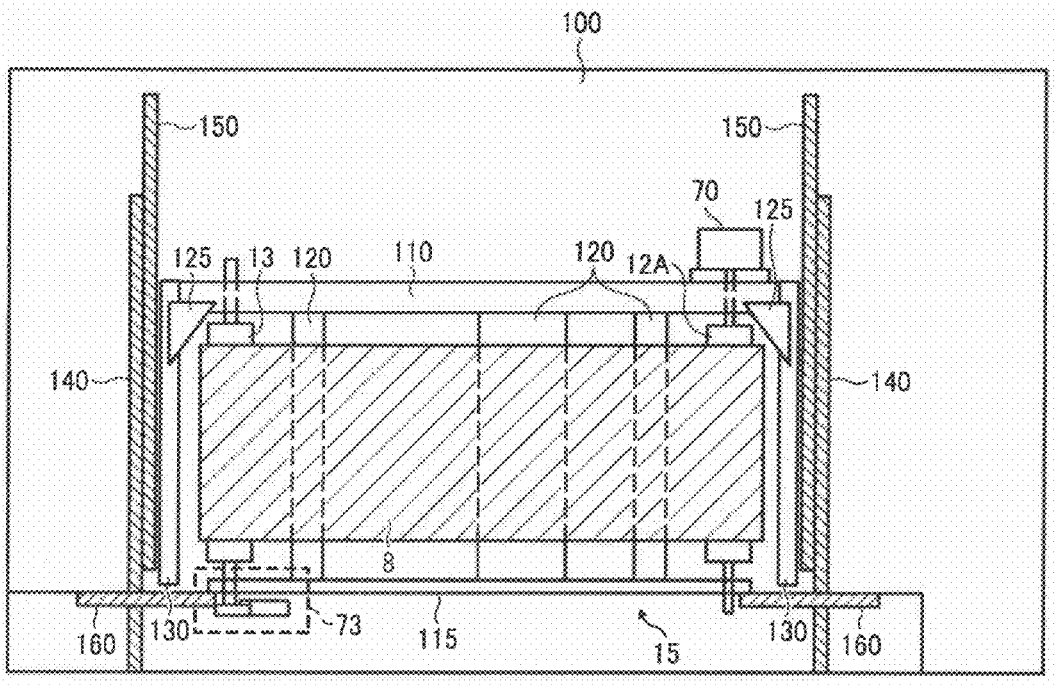
FIG. 9 is a plane view of a state where the belt device shown in FIG. 3 is housed within the image forming apparatus.
Figure 10:
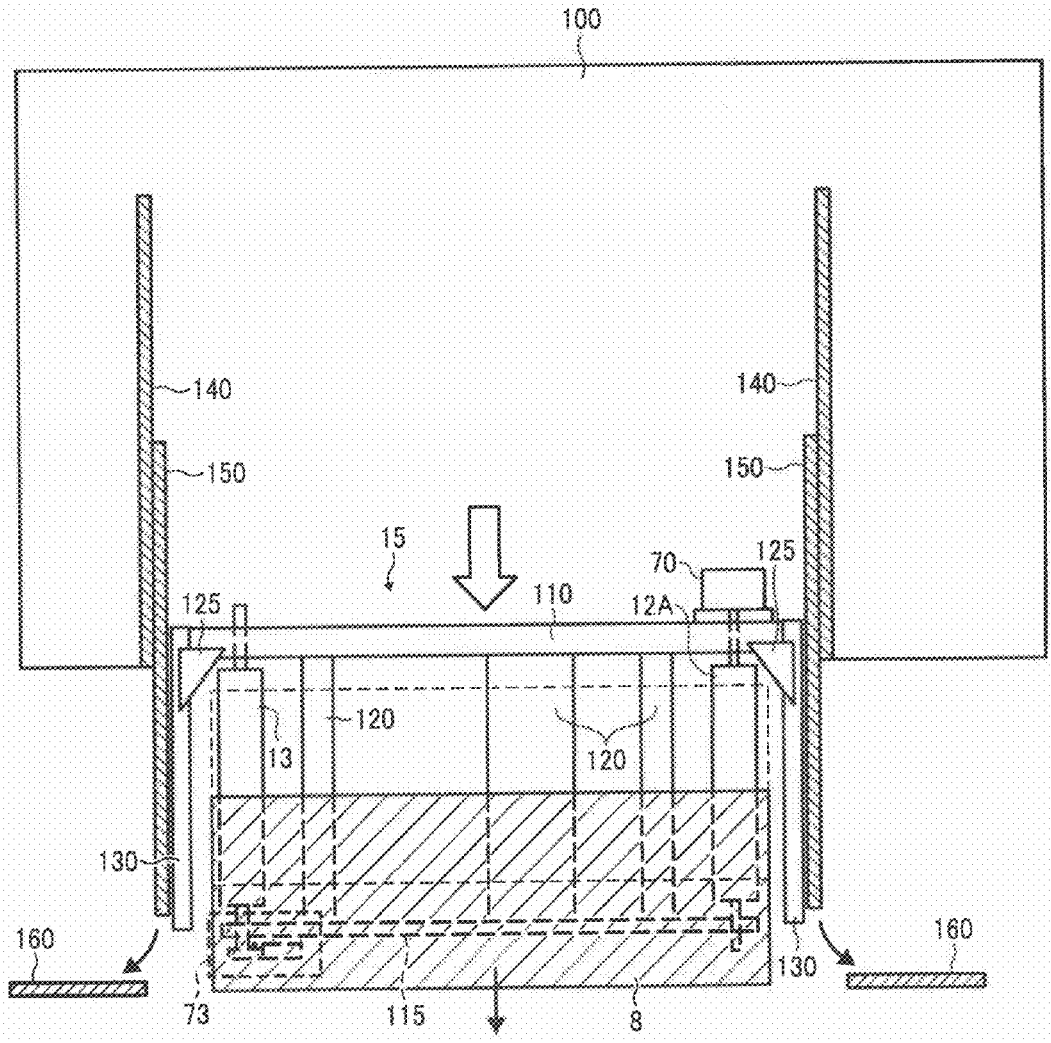
FIGS. 10 and 11 are plane views of a state where the belt device is pulled out of the image forming apparatus.
Figure 11:
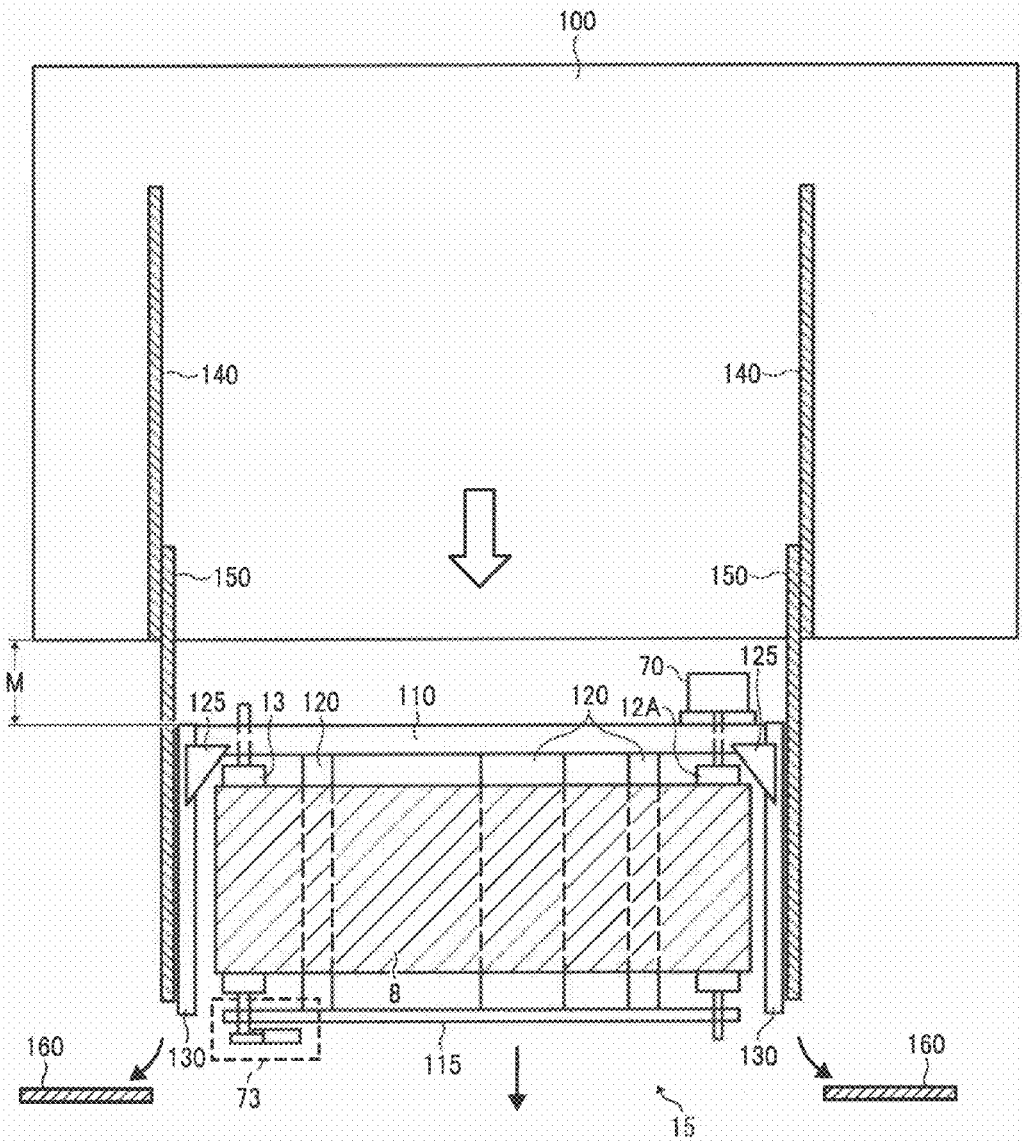
Figure 12:
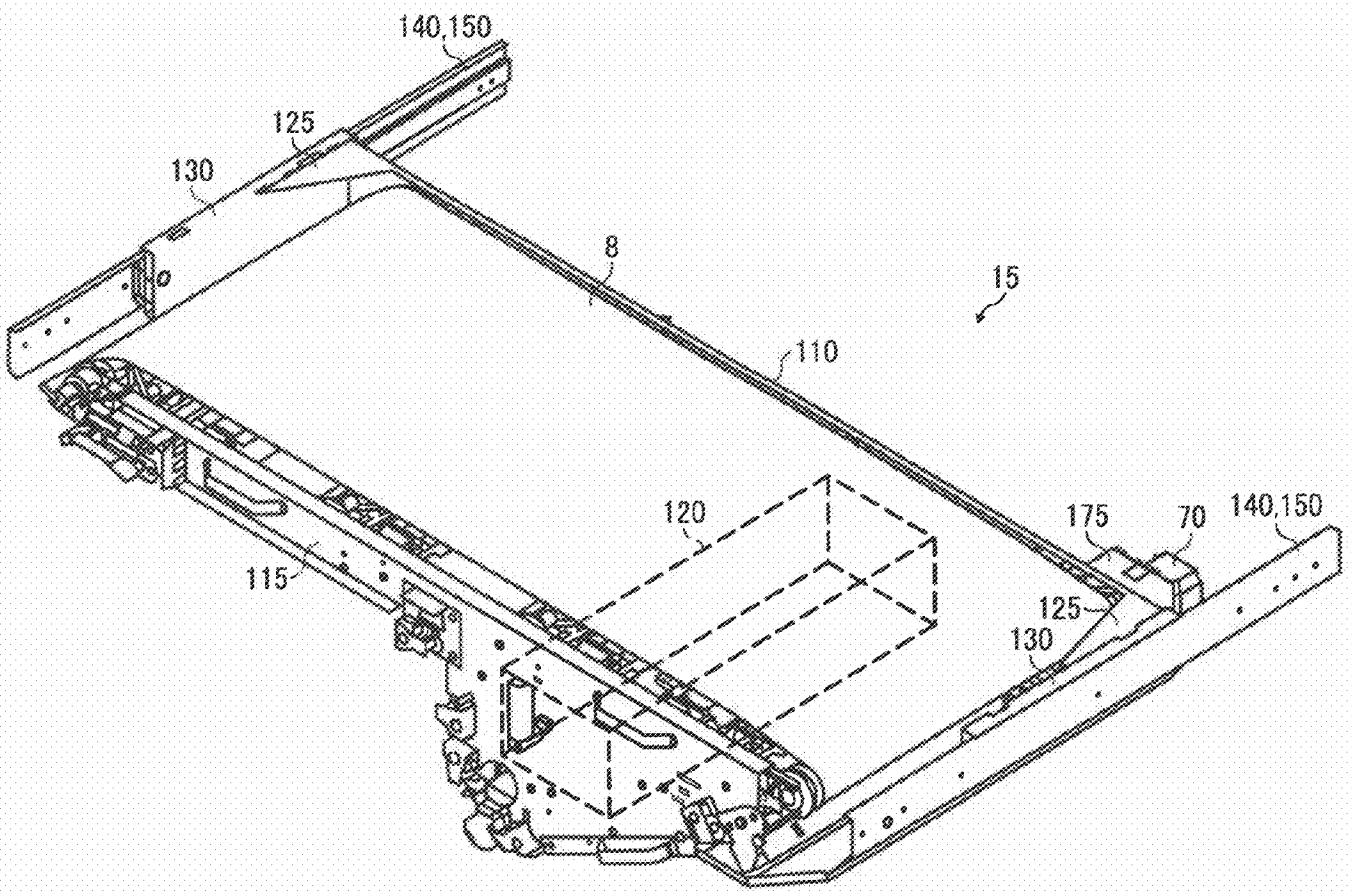
FIG. 12 is a perspective view of the belt device shown in FIG. 3.
Figure 13A:
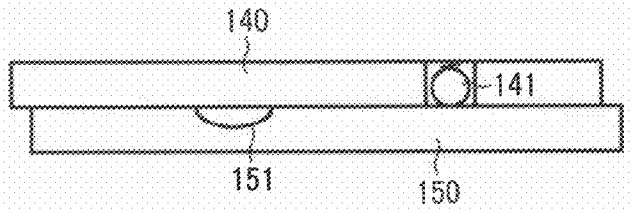
FIGS. 13A to 13C are schematic views for explaining a sliding mechanism.
Figure 13B:
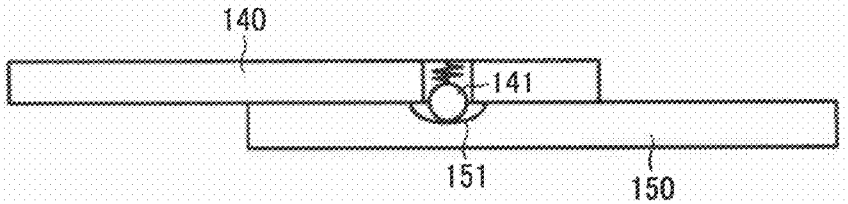
Figure 13C:
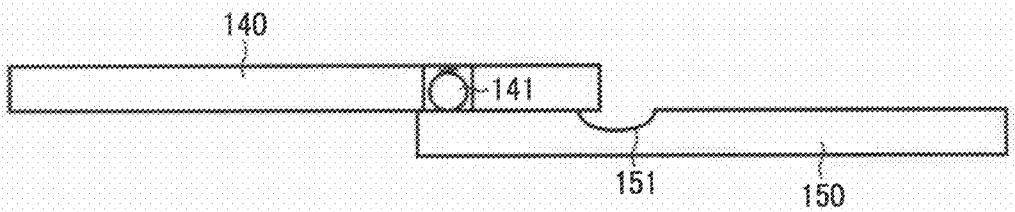
Figure 14:
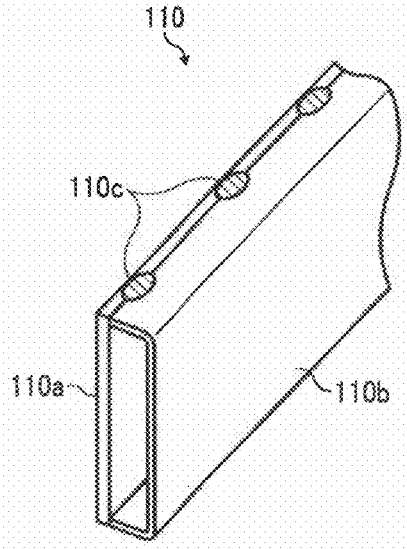
FIG. 14 is a perspective view of a rear frame shown in FIG. 12.
Figure 15:
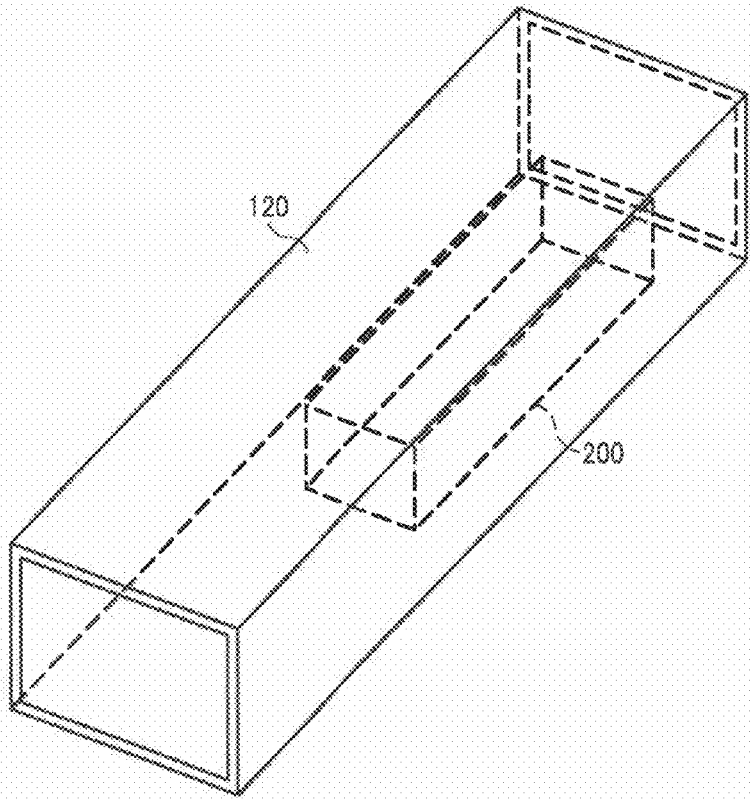
FIG. 15 is a perspective view of a support frame shown in FIG. 12.

In the following, a feature of a first embodiment is described for a configuration for a frame for an intermediate transfer belt device 15 and a maintenance method for changing etc. of the intermediate transfer belt 8 with reference to FIGS. 9 to 15. FIG. 9 is a plane view showing the intermediate transfer belt device 15 housed within the image forming apparatus body 100. FIG. 10 is a plane view showing the intermediate transfer belt device 15 pulled out from the image forming apparatus body 100. FIG. 11 is a plane view showing the intermediate transfer belt device 15 pulled out further from the image forming apparatus body 100. FIG. 12 is a perspective view showing the intermediate transfer belt device 15. FIGS. 13A to 13C are the outline views showing a slide mechanism. FIG. 14 is a perspective view showing a rear frame 110. FIG. 15 is a perspective view showing a support frame 120.

As shown in FIG. 9, the intermediate transfer belt device 15 is supported at the image forming apparatus body 100 via a slider mechanism. The slider mechanism includes slide rails 140 and 150 on two sides. The slide rails 140 and 150 are established at the image forming apparatus body 100 at the outer side (or outside of the intermediate transfer belt device 15) of the outer periphery of the intermediate transfer belt 8. The slide rail 140 is fixed to the sides of the image forming apparatus body 100 and the slide rail 150 is arranged so as to be slidable with respect to the slide rail 140. With the structure for the slide rails 140 and 150, as a result of the operation of the operator carrying out maintenance of the intermediate transfer belt device 15, the intermediate transfer belt device 15 is supported at the image forming apparatus body 100 pulled out to the front with respect to the image forming apparatus body 100, as shown in FIGS. 10 and 11.

Referring to FIGS. 9 to 12, the frame (casing) of the intermediate transfer belt device 15 includes two left and right side frames 130, the rear frame 110, a front frame 115, three support frames 120, and reinforcing frames 125 taken as reinforcing members. These frames are formed from steel material such as stainless steel, etc. Each of the frames are mainly joined using welding.

The two side frames 130 are supported at the slide rails 150 arranged on the outside of the intermediate transfer belt device 15. The rear frame 110 is fixed to the slide rails 150 via the side frames 130.

The rear frame 110 is constructed to the rear (upper part of FIG. 9) between the two side frames 130. The rear frame 110 supports axial sections (rear side axial sections) of a plurality of roller members 12A to 12C, 13, and 14 via bearings in a freely rotatable manner. The rear frame 110 has a box-shaped structure, as shown in FIG. 14. The rear frame 110 is a box-shaped structure formed by welding together (welding at welded sections 110*c* in the drawing) a plane-shaped plate member 110*a* (hereinafter, main frame 110*a*) and a plate member 110*b* (hereinafter, sub-frame 110*b*) bent into the shape of an inverted-C. By making the rear frame 110 box-shaped, resistance to torsion is increased by not making the weight of the rear frame 110 greater than is necessary and deformation of the frame as a whole can be suppressed.

The front frame 115 is fixed to the rear frame 110 via the support frame 120. The front frame 115 rotatably supports the shafts (front side shafts) of the plurality of roller members 12A to 12C, 13, 14 via bearings. Shafts at the ends of the plurality of roller members 12A to 12C, 13, and 14 are rotatably supported by the rear frame 110 and the front frame 115 via bearings. The front frame 115 has a smaller projecting surface than the inner periphery (inner periphery of the intermediate transfer belt 8 with the belt tension released) of the intermediate transfer belt 8 when viewed from the front (in a pulling out direction at the lower part of FIG. 9). It is therefore possible to insert and detach the intermediate transfer belt 8 without the front frame 115 interfering with the intermediate transfer belt 8 while the intermediate transfer belt device 15 is pulled out from the image forming apparatus body 100, as shown in FIG. 10. A length in a longitudinal direction (lateral direction of FIG. 9) of the front frame 115 is set to be shorter than the span of a link linking outermost peripheral positions of a drive roller 12A and the correction roller 13. Further, a gap (a gap that is at least sufficient for an operator to change a belt) is provided between the front frame 115 and the side frames 130. In the first embodiment, the side frames 130 are arranged with a clearance of at least 35 millimeters in a widthwise direction (lateral direction in FIG. 9) with respect to the intermediate transfer belt 8 (intermediate transfer belt 8 positioned at the intermediate transfer belt device 15). It is therefore possible to easily attach and remove the intermediate transfer belt 8 to and from the device 15 in a widthwise direction.

The three support frames 120 are arranged so as to provide cantilever support for the front frame 115 with respect to the rear frame 110. One of the support frames 120 (referring to FIG. 12, a support frame near a secondary transfer roller 19) is formed in the shape of a box, as shown in FIG. 15. As a result, it is possible to increase resistance to torsion without making the support frame 120 too heavy and it is possible to suppress deformation of the frame as a whole. Referring to FIG. 15, electrical components 200 such as high-voltage supplies for applying a high bias to the transfer rollers 9Y, 9M, 9C, and 9K are arranged within the box-shaped support frame 120. As a result, it is possible to prevent the electrical components 200 from becoming damaged and to prevent electrocution as a result of touching high-voltage power supplies when an operator carries out maintenance on the intermediate transfer belt device 15.

The reinforcing frames 125 taken as reinforcing members are constructed across both the frames 110 and 130 near joints of the side frames 130 and the rear frame 110. The resistance to torsion of the rear frame 110 cross-linking the two side frames 130 is therefore increased and the strength of connecting both the frames 110 and 130 is increased. The reinforcing frames 125 (reinforcing members) are substantially triangular in shape. The reinforcing frames 125 therefore function effectively as reinforcing members without space near the joints of the side frames 130 and the rear frame 110 becoming narrow. In the first embodiment, the reinforcing frame 125 is arranged with a clearance of 20 millimeters or more in the vertical direction (direction at right-angles to the paper surface of FIG. 9) with respect to the intermediate transfer belt 8. It is therefore possible to reduce the likelihood of scratches occurring as a result of the intermediate transfer belt 8 interfering with the reinforcing frame 125 when changing the intermediate transfer belt 8 without the intermediate transfer belt device 15 becoming too large.

In the first embodiment, fixing plates 160 are provided as fixing members for fixing the front frame 115 to the image forming apparatus body 100 with the intermediate transfer belt device 15 housed in the image forming apparatus body 100 (the situation in FIG. 9). The fixing plates 160 taken as fixing members prevent the intermediate transfer belt device 15 from sliding to the front when the intermediate transfer belt device 15 is not being maintained. At times other than during maintenance, the fixing plates 160 increase strength of the frame as a whole without providing cantilever support to the front frame 115. The fixing plates 160 are provided so as to be freely detachable to the front side of the image forming apparatus body 100 so as to engage with the front frame 115 as a result of fastening with screws.

The intermediate transfer belt 8 can be pulled out to the front from the intermediate transfer belt device 15 using the following procedure. First, the fixing plates (fixing members) 160 are removed from the image forming apparatus body 100 by the operator. The intermediate transfer belt device 15 is then pulled out (moved in the direction of the white arrow of FIG. 10) towards the operator side (to the front) with a grip (not shown) of the intermediate transfer belt device 15 gripped. In the situation in FIG. 10, rather than the whole of the intermediate transfer belt device 15 being completely exposed from the image forming apparatus body 100, just part of the intermediate transfer belt device 15 is exposed from the image forming apparatus body 100 (the intermediate transfer belt 8 is exposed). Referring to FIG. 10, belt tension is released by moving the tension roller 12C with the intermediate transfer belt device 15 held in a pulled-out state. The intermediate transfer belt 8 is then pulled out to the operation side (to the front) (movement in the direction of the arrow of FIG. 10) and the extraction of the belt from the intermediate transfer belt device 15 is complete. The operation of installing a new intermediate transfer belt at the intermediate transfer belt device 15 is the reverse of the operation at the time of extraction. In the first embodiment, it is possible to change the intermediate transfer belt 8 with one action with the intermediate transfer belt device 15 pulled out to the front with respect to the image forming apparatus body 100. The operation of attaching and detaching the intermediate transfer belt device 15 is not limited to changing the intermediate transfer belt 8 and can also be carried out for cases such as jam processing when a jam occurs near the intermediate transfer belt device 15.

Referring to FIGS. 10 and 11, the slide rails 140 and 150 are constructed so that the intermediate transfer belt device 15 is pulled out in two stages. The intermediate transfer belt device 15 pulled out from the image forming apparatus body 100 as shown in FIG. 10 can be pulled out from the image forming apparatus body 100 (the situation in FIG. 11). Specifically, referring to FIGS. 13A to 13C, spherical engaging members 141 urged by springs are disposed at the slide rail 140. Semi-spherical grooves 151 are then disposed at the slide rails 150 of the slide mechanism.

When the intermediate transfer belt device 15 is pulled out from the state in FIG. 9, the slide rails 140 and 150 move from the situation of FIG. 13A to the situation of FIG. 13B (the engaging members 141 engage with the grooves 151, with the operator experiencing a clicking sensation). The slide rails 140 and 150 then stop in the state shown in FIG. 10 (a first stage pull-out position). When the intermediate transfer belt device 15 is then pulled out further from the state of FIG. 10, the slide rails 140 and 150 move from the state of FIG. 13B to the state of FIG. 13C (a state where engagement of the engaging members 141 and the grooves 151 is released) and stop in the state of FIG. 11 (a second stage pull-out position). In the state of FIG. 11, the engaging members 141 of the holding sections 140 engage with grooves (not shown) of the slide rail 150 and the operator experiences a clicking sensation.

In the state in FIG. 11, the whole of the intermediate transfer belt device 15 is exposed in its entirety from the image forming apparatus body 100 (a drive motor 70 is exposed). Specifically, in the first embodiment, a distance M between the rear frame 110 and the image forming apparatus body 100 is set to the order of 300 millimeters. Referring to FIG. 11, maintenance of structural components such as the drive motor 70 fixed to the rear frame 110 is carried out in a state where the intermediate transfer belt device 15 is pulled out and held. The operation of installing the intermediate transfer belt device 15 in the image forming apparatus body 100 after completion of the maintenance is then carried out using the reverse procedure of the procedure at the time of pulling out.

In the first embodiment, as shown in FIG. 10 and FIG. 11, even if a situation where the intermediate transfer belt device 15 is held pulled out is maintained for a long time, the rear frame 110 a torsion load focuses on has a box-type structure. The reinforcing frames 125 are also disposed between the rear frame 110 and the side frames 130 and the support frame 120 is also shaped like a box. It is therefore possible to suppress deformation of the frame as a whole. It is therefore also possible to suppress deterioration of image quality of images output as a result of frame deformation of the intermediate transfer belt device 15.

In the first embodiment, the front frame 115 having a projecting surface smaller than the inner periphery of the intermediate transfer belt 8 (belt member) as viewed from the front is cantilever-supported with respect to the rear frame 110. Mechanical strength with respect to force applied to the intermediate transfer belt device 15 (belt device) when the image forming apparatus body 100 is pulled out is therefore effectively increased. It is therefore possible to improve ease of maintenance of the intermediate transfer belt device 15 including changing of the intermediate transfer belt 8 without deformation of the intermediate transfer belt device 15.

Figure 16:
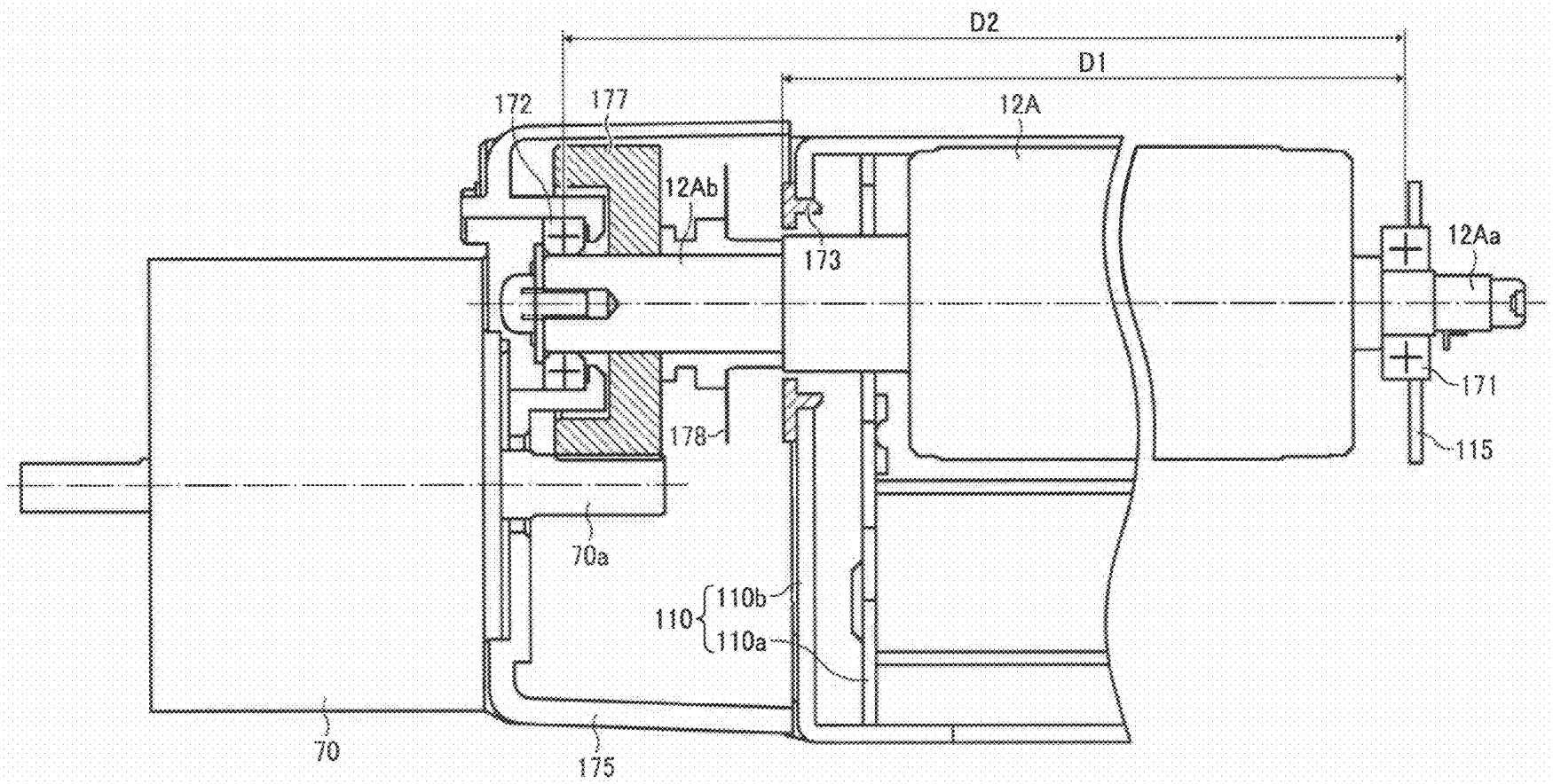
FIG. 16 is a schematic view showing the essential parts of a belt device according to a second embodiment of the present invention.
Figure 17:
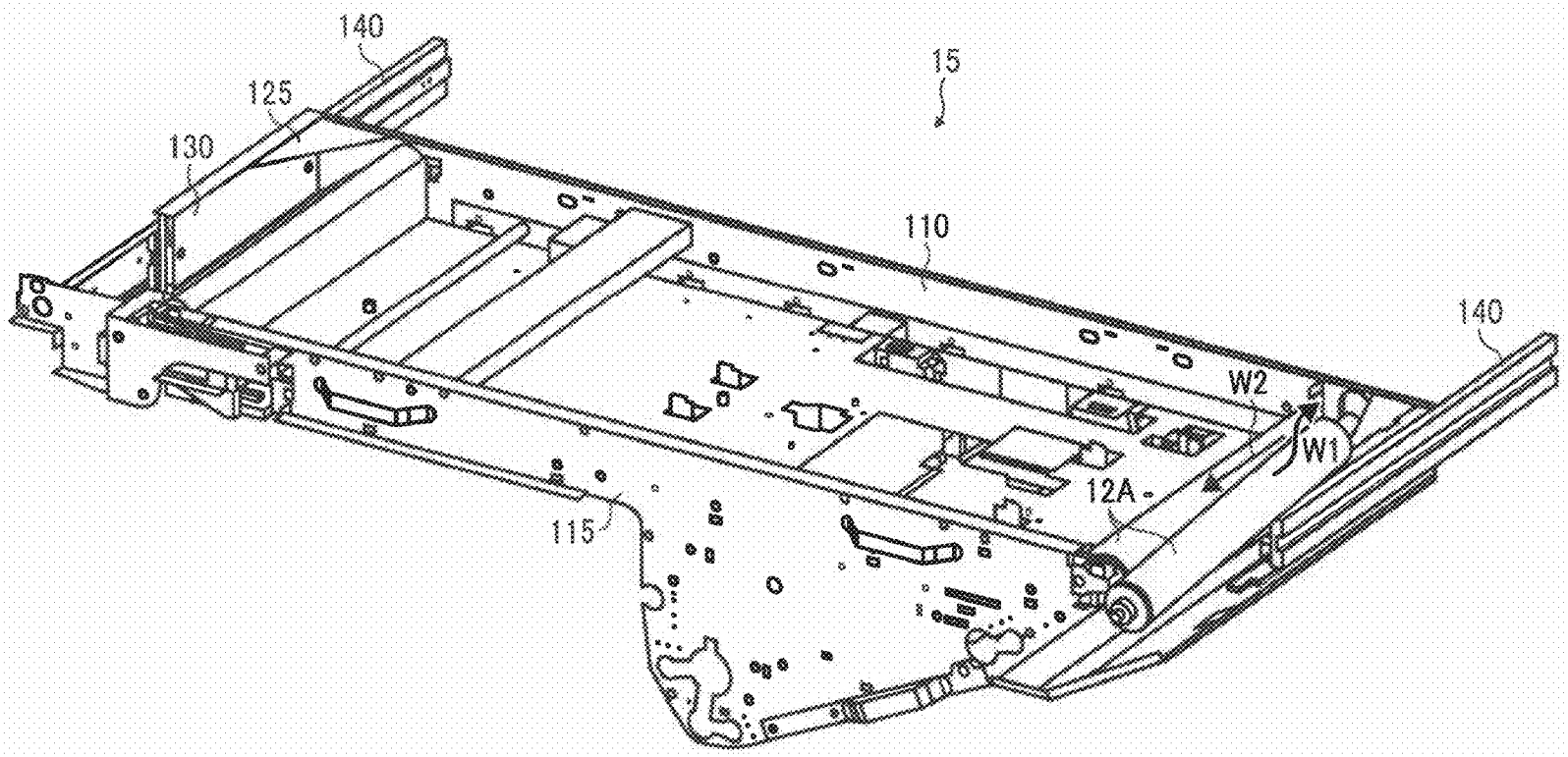
FIG. 17 is a perspective view for explaining a procedure for assembling a drive roller to the belt device shown in FIG. 16.
Figure 18:
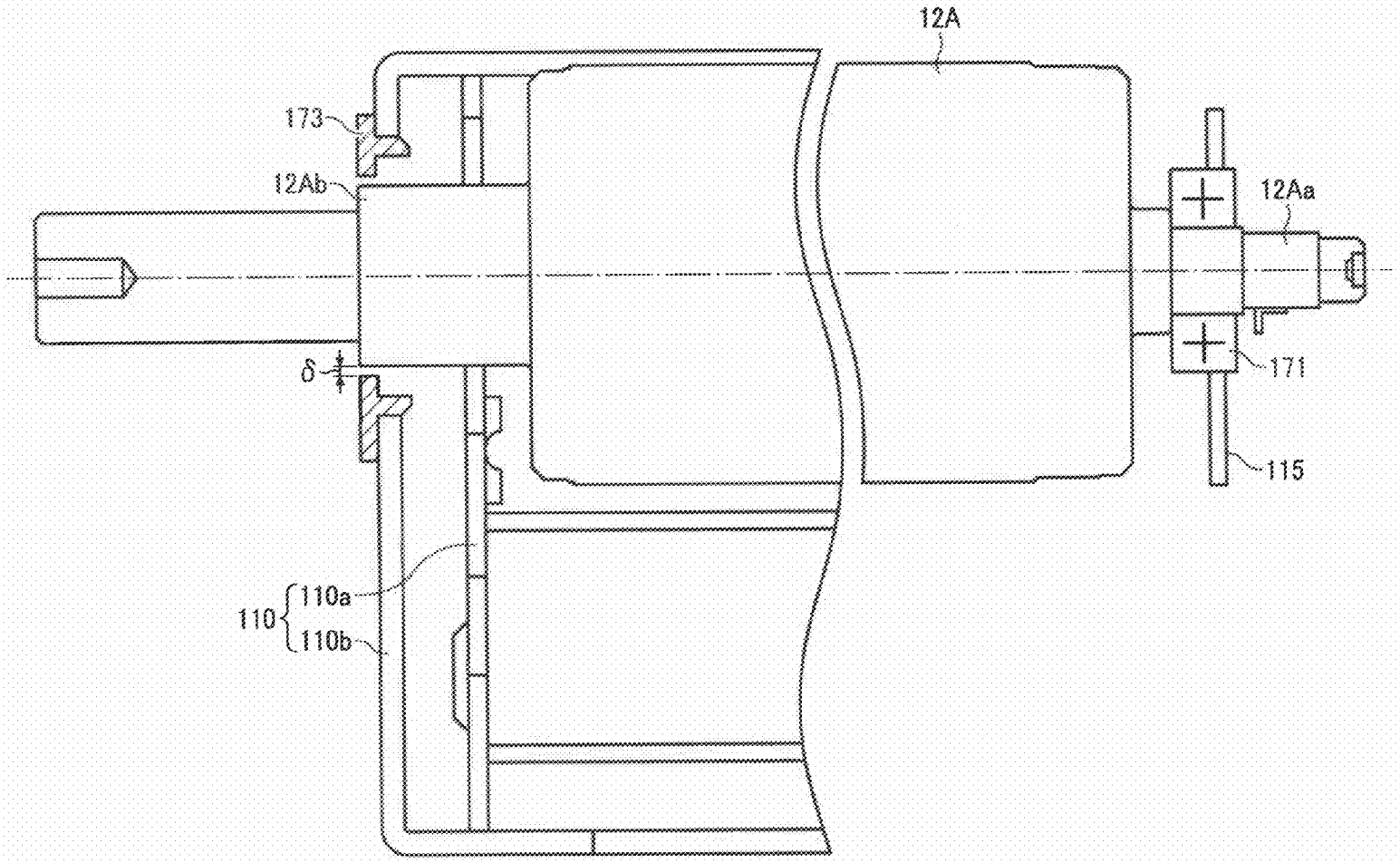
FIG. 18 is a diagram showing the belt device shown in FIG. 17 with a holding member taken out.
Figure 19:
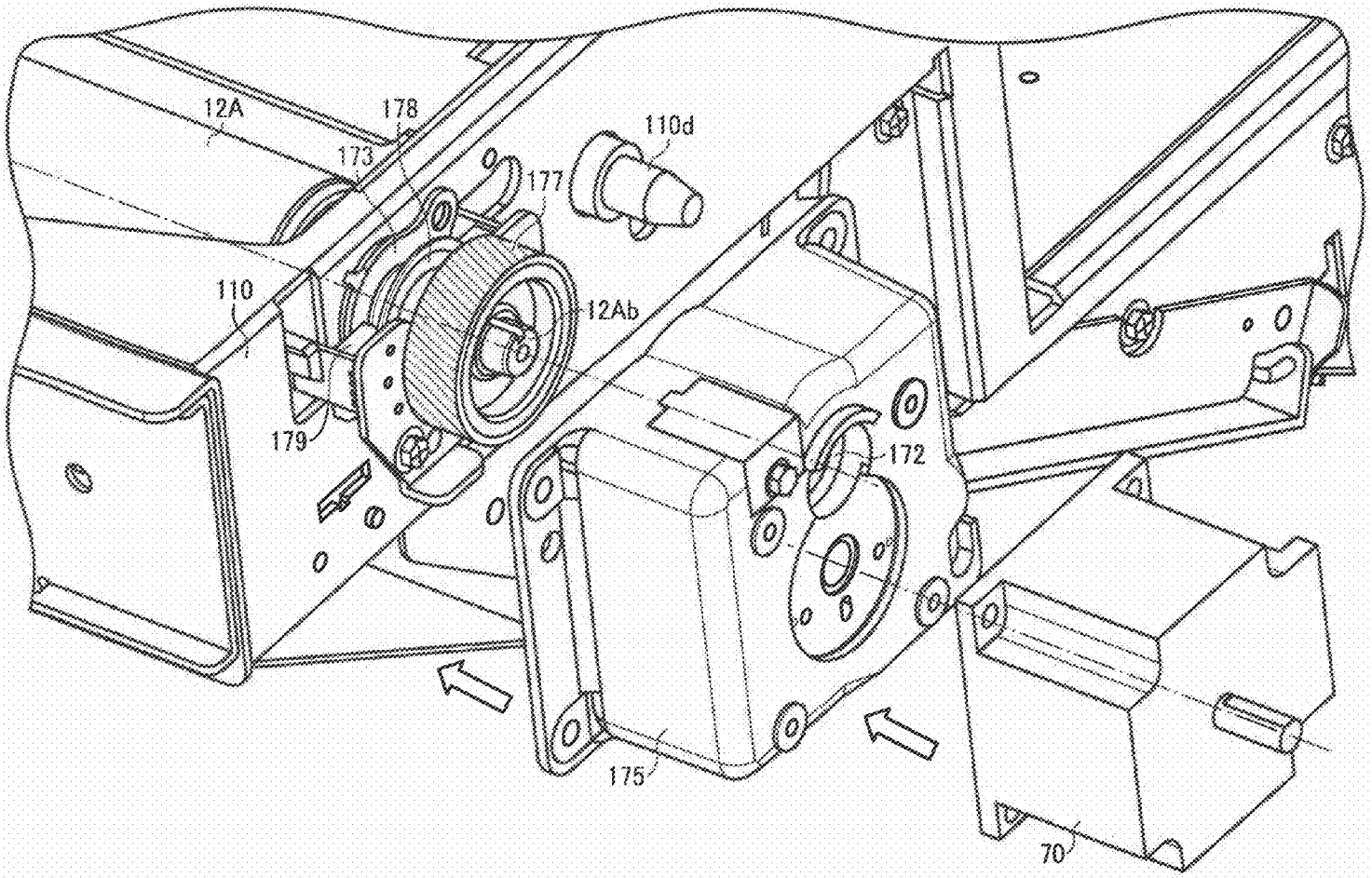
FIG. 19 is an exploded perspective diagram showing near a rear side of the drive roller shown in FIG. 16.
Figure 20:
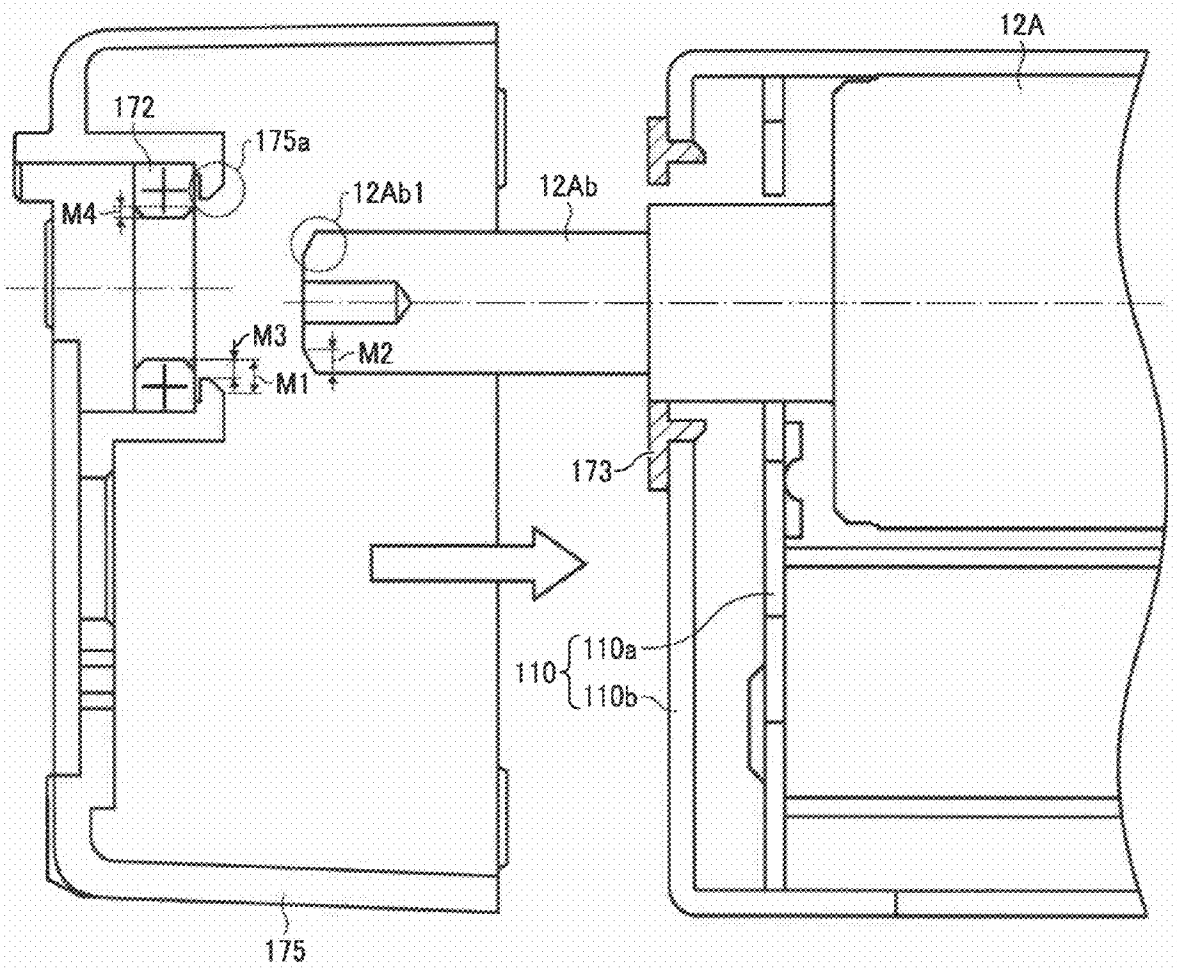
FIG. 20 is a diagram showing the belt device shown in FIG. 16 with the holding member installed.
Figure 21:
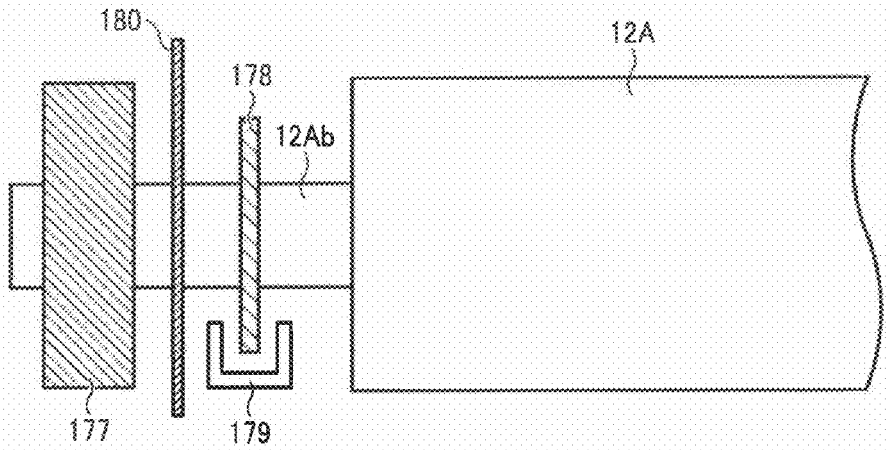
FIG. 21 is a schematic view showing near a rear side shaft of the drive roller shown in FIG. 16.

A second embodiment of the present invention is now explained in detail using FIGS. 16 to 21. FIG. 16 is a schematic diagram showing the essential parts of an intermediate transfer belt device according to a second embodiment. FIG. 16 is a cross-sectional side-view showing near the drive roller 12A. FIG. 17 is a view showing assembly of the drive roller 12A to the intermediate transfer belt device 15. FIG. 18 is a view showing the intermediate transfer belt device 15 with a holding cover 175 extracted. FIG. 19 is an exploded perspective view showing near a rear side of the drive roller 12A. FIG. 20 is a view showing the intermediate transfer belt device 15 with the holding cover 175 extracted. FIG. 21 is an outline view showing near a rear side shaft 12Ab of the drive roller 12A. The intermediate transfer belt device 15 of the second embodiment differs from that of the first embodiment in that a sub-bearing 173 is disposed at the rear frame 110.

The intermediate transfer belt device 15 of the second embodiment also includes the intermediate transfer belt 8, the four transfer rollers 9Y, 9M, 9C, and 9K, the drive roller 12A, the tension rollers 12B and 12C, the correction roller 13, the restricting roller 14, the meandering detecting unit 80, the abnormality detecting unit 88, a photosensor 901, and the intermediate transfer cleaning unit 10, etc. (see FIG. 3) as with the first embodiment. As with the first embodiment, the intermediate transfer belt device 15 of the second embodiment is also a frame (casing) including left and right side frames 130, the rear frame 110, the front frame 115, the support frame 120, and the reinforcing frame 125 where the image forming apparatus body 100 is supported via the slide rails 140 and 150 (see FIG. 9 etc.). Further, as explained previously in FIG. 14, the rear frame 110 is formed in the shape of a box by joining a sub-frame 110*b* subjected to bending to the main frame 110*a* using welding. A positioning stud 110*d* taken as a positioning member for positioning with the image forming apparatus body 100 is disposed at the main frame 110*a* of the rear frame 110. Specifically, the positioning stud 110*d* of the rear frame 110 engages with a hole (not shown) formed in the casing of the image forming apparatus body 100 so as to position the intermediate transfer belt device 15 with respect to the image forming apparatus body 100.

Referring to FIG. 16, the drive roller 12A taken as a roller member is rotatably driven by the drive motor 70 via gear trains 70*a* and 177. The intermediate transfer belt 8 therefore travels in a prescribed travel direction (the clockwise direction of FIG. 3). A rubber layer is formed on the surface of the drive roller 12A. A coefficient of friction with the intermediate transfer belt 8 is therefore increased and it is possible to reliably grip the intermediate transfer belt 8. The precision (speed stability) of the traveling speed of the intermediate transfer belt 8 has a substantial effect on the quality of the outputted images. The drive roller 12A is therefore controlled so as to be rotatably driven at the desired rotational speed. Specifically, referring to FIG. 16, FIG. 19, and FIG. 21, an encoder disc 178 (formed with radial slits on an outer periphery) is disposed at the rear side shaft 12Ab of the drive roller 12A. An encoder sensor 179 (constructed from a light-emitting element and a light-receiving element) is disposed at the rear frame 110 so as to sandwich the encoder disc 178. Although omitted from the drawings, an encoder disc is arranged at a shaft of a driven roller (one roller member of the plurality of roller members 12A to 12C, 13, and 14, excluding the drive roller 12A). An encoder sensor is then disposed so as to sandwich this encoder disc. Rotational speed of the drive roller 12A is then controlled by detecting fluctuations of a pulse outputted by the encoder sensor facing the encoder disc driven together with the driven roller for feedback to an input pulse of the drive motor 70. A pulse outputted from the encoder sensor 179 facing the encoder disc 178 rotating together with the drive roller 12A is then detected. Fluctuation in thickness of the intermediate transfer belt 8 is then obtained from a differential of the detected value and a detected value for a pulse outputted by an encoder sensor on the driven roller-side and correction of the rotational speed of the drive roller 12A is controlled.

Referring to FIG. 16, in an intermediate transfer belt device 15 of the second embodiment, the holding cover 175 taken as a holding member held by a rear side bearing 172 is disposed in a freely detachable manner at the rear frame 110. The rear side bearing 172 supports the rear side shaft 12Ab of the drive roller 12A in a freely rotatable manner. The sub-bearing 173 having an internal diameter larger than the outer diameter (shaft diameter) of the rear side shaft 12Ab of the drive roller 12A is disposed at the rear frame 110 at a position more to the side of the center in an axial direction (right side of FIG. 16) than the position of the rear side bearing 172. On the other side, a front side bearing 171 that supports the front side shaft 12Aa of the drive roller 12A in a freely rotatable manner is disposed at the front frame 115.

Normally (when the intermediate transfer belt device 15 is installed at the image forming apparatus body 100), the drive roller 12A (roller member) is supported in a freely rotatable manner at the intermediate transfer belt device 15 by the front side bearing 171 and the rear side bearing 172. When the intermediate transfer belt device 15 is then pulled out from the image forming apparatus body 100 and the holding cover 175 is taken out from the rear frame 110, the drive roller 12A is supported at the intermediate transfer belt device 15 by the front side bearing 171 and the sub-bearing 173. This means that even when the intermediate transfer belt device 15 is pulled out from the image forming apparatus body 100 and the intermediate transfer belt device 15 is cantilever-supported by the slide rails 140 and 150 so that frame deformation occurs, an end (rear side shaft 12Ab) of the drive roller 12A is supported by the sub-bearing 173 provided with clearance. The inconvenience of an unbalanced load accompanying frame deformation being applied to the drive roller 12A is therefore suppressed. When the drive roller 12A is supported by three or more bearings, (for example, when a main bearing is installed with no clearance at the position of the sub-bearing 173), when the intermediate transfer belt device 15 is then cantilever-supported by the slide rails 140 and 150 during maintenance so that the frame is deformed, the drive roller 12A is subjected to an unbalanced load accompanying deformation of the frame, the straightness of the drive roller 12A is lowered, and coaxiality of the plurality of bearings collapses. As a result, when the intermediate transfer belt device 15 operates normally, the drive roller 12A is subjected to substantial stress during the rotational period and may break in the worst case scenario. When the sub-bearing 173 is not provided and the drive roller 12A is supported by just two bearings, the posture of the drive roller 12A is not stable until the two bearings are installed at the intermediate transfer belt device 15. This is detrimental to the assembly and maintenance of the intermediate transfer belt device 15. In the second embodiment, the sub-bearing 173 having clearance is provided in addition to the front side bearing 171 and the rear side bearing 172. This improves ease of assembly of the intermediate transfer belt device 15 and makes maintenance such as changing the drive roller 12A while the intermediate transfer belt device 15 is pulled out from the image forming apparatus body 100 straightforward.

This is explained in detail in the following using FIGS. 16 to 21. The front side bearing 171 and the rear side bearing 172 that normally hold the drive roller 12A in the radial direction are main bearings. The rear side bearing 172 is press-fitted to the holding cover 175 (holding member). The drive motor 70 is screw-fastened to the holding cover 175. The gear 177 disposed at the rear side shaft 12Ab of the drive roller 12A meshes with the drive gear train 70*a* disposed at the motor shaft of the drive motor 70. A distance between axes of rotation of the gears 70*a* and 177 is decided precisely by the holding cover 175. The holding cover 175 includes the gear trains 70*a* and 177, the encoder disc 178, and the encoder sensor 179. This prevents the encroaching of coarse particulate such as toner, prevents coarse particulate from becoming affixed to the gear trains 70*a* and 177, and prevents detection precision from deteriorating due to the encoder disc 178 and the encoder sensor 179 becoming soiled. The holding cover 175 (holding member) is formed of a material that is highly radiant to heat such as aluminum. Heat generated within the holding cover 175 is then dissipated directly to outside of the holding cover 175 or is dissipated indirectly via the rear frame 110. This prevents erroneous operation of the encoder sensor 179 due to heating and prevents the rear side bearing 172 from locking due to heat.

The sub-bearing 173 is formed of a low-friction material such as polyacetal or oil-impregnated sintered metal. A clearance δ with respect to the rear side shaft 12Ab of the drive roller 12A (see FIG. 18) is set to 0.7 millimeter. When the clearance δ with respect to the rear side shaft 12Ab of the drive roller 12A is set to be large, there is the possibility of coarse particulate becoming affixed to the encoder disc 178 and the encoder sensor 179 etc. disposed within the holding cover 175. When the clearance 6 is set to be small, there is the possibility that the effect of disposing the sub-bearing 173 will no longer be sufficient. In the second embodiment, the clearance δ is set in the order of 0.7 millimeter to take these factors into consideration. To take into consideration the sub-bearing 173 provided with clearance coming into contact with the rear side shaft 12Ab, the sub-bearing 173 is made of a low friction material to ensure that problems do not occur even if the sub-bearing 173 functions as a bearing during operation of the intermediate transfer belt device 15.

Next, a procedure for assembling the drive roller 12A to the frame of the intermediate transfer belt device 15 during manufacture is explained. Referring to FIG. 17, first, the rear side shaft 12Ab of the drive roller 12A the front side bearing 171 is press-fitted into is inserted in the direction of an arrow W1 to the frame (connected by welding of the rear frame 110, the front frame 115, the side frames 130, and the reinforcing frames 125, etc.) of the intermediate transfer belt device 15. The front side bearing 171 is then installed in the direction of the arrow W2 so as to engage with the front frame 115. At this time, the drive roller 12A is only supported at one side by the front side bearing 171 and the posture of the drive roller 12A is undecided and unstable. A thrust stopper (not shown) engaging with an outer ring of the front side bearing 171 is then screw-fastened to the front frame 115 in order to restrict movement of the front side bearing 171 in the thrust direction (axial direction). As shown in FIG. 18, the sub-bearing 173 is then inserted to the rear frame 110. The posture of the drive roller 12A therefore stabilizes within a range of the clearance δ of the sub-bearing 173 and the rear side shaft 12Ab. The posture of the drive roller 12A then remains unstable within the range of the clearance δ but is sufficiently stable to carry out subsequent operations.

In the second embodiment, the position of the center of gravity of the drive roller 12A is between the front side bearing 171 and the sub-bearing 173. When the position of the center of gravity of the drive roller 12A is not between the front side bearing 171 and the sub-bearing 173, when the drive roller 12A is supported by the front side bearing 171 and the sub-bearing 173, according to lever theory, a substantial load is applied to the front side bearing 171 and the sub-bearing 173 and the drive roller 12A is supported in an unstable manner.

After this, the encoder disc 178 and the gear 177 are arranged on the rear side shaft 12Ab and the encoder sensor 179 is also fitted at this time. The drive motor 70 and the holding cover 175 supported by the rear side bearing 172 are then inserted from the rear of the drive roller 12A, as shown in FIG. 19. The holding cover 175 is then fixed to the main frame 110*a* of the rear frame 110 using studs (not shown).

Referring to FIG. 20, a tapered section 175*a* (guide section) that guides the rear side shaft 12Ab of the drive roller 12A supported by the sub-bearing 173 and the front side bearing 171 to the rear side bearing 172 at the time of installation in the rear frame 110 is provided at the holding cover 175. A tapered section 12Ab1 (C plane) is provided at the end at the rear side shaft 12Ab of the drive roller 12A. As shown in FIG. 20, the drive roller 12A has a posture tilted by a portion of just the clearance δ with the sub-bearing 173 when the holding cover 175 is not installed at the rear frame 110. Installation therefore has to take place so that the drive roller 12A can be scooped up by the holding cover 175 when the holding cover 175 is installed at the rear frame 110. In the second embodiment, the tapered section 175*a* is provided near the rear side bearing 172 of the holding cover 175. The tapered section 12Ab1 is also provided at the end of the rear side shaft 12Ab of the drive roller 12A. A component force therefore acts in a direction of scooping up of the rear side shaft 12Ab of the drive roller 12A due to the inclination of both of the tapered sections 12Ab1 and 175*a* as a result of the holding cover 175 being made to move in the direction of the white arrow of FIG. 20. The rear side shaft 12Ab and the rear side bearing 172 therefore engage smoothly.

The following configuration enables the rear side shaft 12Ab and the rear side bearing 172 to engage in a smooth manner. Referring to FIGS. 16, 18, and 20, when the distance in an axial direction from the front side bearing 171 to the sub-bearing 173 is taken to be D1, the distance in an axial direction from the front side bearing 171 to the rear side bearing 172 is taken to be D2, clearance between the sub-bearing 173 and the rear side shaft 12Ab is taken to be δ, a distance in a vertical direction from an internal diameter section of the rear side bearing 172 to the lower end of the tapered section 175*a* of the holding cover 175 is taken to be M1, and a distance in a vertical direction from the upper end of the tapered section 12Ab1 of the rear side shaft 12Ab to the lower end is taken to be M2, then a relationship of $\delta<(D2/D1)\times(M1+M2)$ is satisfied. In the above equation, it can be geometrically derived based on the condition that the distance D1 is extremely large compared to the clearance δ that the relationship of approximately $D1:\delta=D2:(M1+M2)$ gives the boundary conditions for engagement of the rear side shaft 12Ab and the rear side bearing 172.

When a distance in a vertical direction from an internal diameter section of the rear side bearing 172 to the upper end of the tapered section 175*a* of the holding cover 175 is taken to be M3, and the height of an R-section formed at the internal diameter section of the rear side bearing 172 is taken to be M4, it is preferable for the relationship $M2+M4>M3$ to be satisfied. By forming the internal diameter section (R-section) of the rear side bearing 172 in this manner, after the rear side shaft 12Ab of the drive roller 12A is scooped up by the tapered section 175*a* of the holding cover 175, a series of operations is carried out smoothly until the rear side shaft 12Ab is inserted to the rear side bearing 172. In the second embodiment, a distance D1 of 417 millimeters, a distance D2 of 442 millimeters, a clearance δ of 1 millimeter, a distance M1 of 2 millimeters, a distance M2 of 1 millimeter, a distance M3 of 1 millimeter, and a distance M4 of 0.3 millimeter are set in the second equation.

An explanation is given below of maintenance of the periphery of the drive roller 12A of the intermediate transfer belt device 15. Maintenance such as changing is carried out as a result of degradation etc. of the rubber layer of the surface for the drive roller 12A. Checking or changing of parts is carried out when the gear 177 of the drive roller 12A degrades due to wear or the encoder disc 178 or the encoder sensor 179 becomes damaged. For example, when the gear 177 is changed, the intermediate transfer belt device 15 is pulled out from the image forming apparatus body 100 as shown in FIG. 10. Parts are then removed in the reverse order to the assembly procedure at the time of manufacture and the gear 177 is changed. The intermediate transfer belt device 15 is therefore cantilever-supported in a pulled-out state during maintenance. The frame of the intermediate transfer belt device 15 is considered to maintain sufficient strength but even so the frame flexes slightly. This flexure is substantially parallel to the axial direction of the drive roller 12A. When the clearance δ between the sub-bearing 173 and the rear side shaft 12Ab becomes 0 (when the drive roller 12A is supported by the three bearings), a force acts away from the bearings along the same straight line. This exerts substantial stress on the drive roller 12A and is the cause of fatigue. It is therefore necessary to provide an appropriate clearance δ between the sub-bearing 173 and the rear side shaft 12Ab.

The case of installing a normal bearing (referred to as a "center bearing" below where clearance δ with the rear side shaft 12Ab is not provided) in place of the sub-bearing 173 of the second embodiment is also considered. In this event, the rear side bearing 172 is installed with the drive roller 12A fixed by the front side bearing 171 and the center bearing. Ease of assembly is then good because the drive roller 12A is fixed to the center bearing during manufacture. However, the three bearings are no longer lined up along a straight line in a state where the intermediate transfer belt device 15 is pulled out as explained above during maintenance. It is therefore necessary to consider that stress is not to be applied to the drive roller 12A by making the rigidity of the holding cover 175 holding the rear side bearing 172 sufficiently weak. When the drive roller 12A is changed with the intermediate transfer belt device 15 pulled out, the rear side bearing 172 is fixed on a straight line formed by the front side bearing 171 and the center bearing with the frame flexed. When the intermediate transfer belt device 15 is then installed in the image forming apparatus body 100 and flexing of the frame is eliminated, the three bearings are lined up along the same straight line. When stress is not released to the drive roller 12A by making rigidity of the holding cover 175 sufficiently weak, the drive roller 12A is subjected to stress every time rotation takes place and fatigue failure will occur. However, when the holding cover 175 is formed from low-rigidity material such as resin, various inconveniences occur such as it being difficult for heat occurring at the drive motor 70 etc. to be dissipated occur. In the second embodiment, in addition to the front side bearing 171 and the rear side bearing 172, the sub-bearing 173 having sufficient clearance δ is provided. Ease of assembly of the intermediate transfer belt device 15 is therefore improved without side effects occurring. Maintenance such as changing of the drive roller 12A with the intermediate transfer belt device 15 pulled out from the image forming apparatus body 100 can then be carried out easily.

Referring to FIG. 21, in the second embodiment, a partition 180 is provided between the gear trains 70*a* and 177 and the encoder disc 178 within the holding cover 175. Specifically, the partition 180 is a donut-shaped plate member formed using Mylar and is inserted at the rear side shaft 12Ab between the gear 177 and the encoder disc 178. A situation where detection precision of the encoder is lowered as a result of grease flying off and becoming attached to the encoder disc 178 and the encoder sensor 179 is avoided even when grease is applied to the faces of teeth of the gear trains 70*a* and 177.

In the second embodiment, as in the first embodiment, the front frame 115 having a smaller projecting surface than the inner periphery of the intermediate transfer belt 8 (belt member) as viewed from the front is cantilever-supported with respect to the rear frame 110. The mechanical strength with respect to force applied to the intermediate transfer belt device 15 (belt device) is also effectively increased when the intermediate transfer belt device 15 is pulled out from the image forming apparatus body 100. It is therefore possible to increase ease of maintenance of the intermediate transfer belt device 15 including changing of the intermediate transfer belt 8 without deformation of the intermediate transfer belt device 15 occurring.

Figure 22:
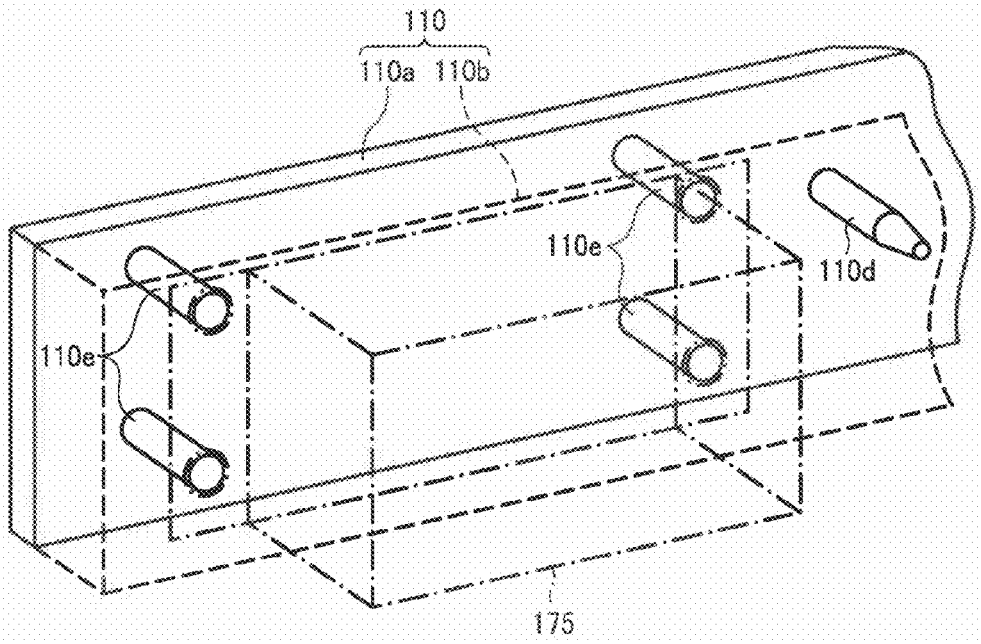
FIG. 22 is a perspective view showing the essential parts of a belt device according to a third embodiment of the present invention.
Figure 23A:
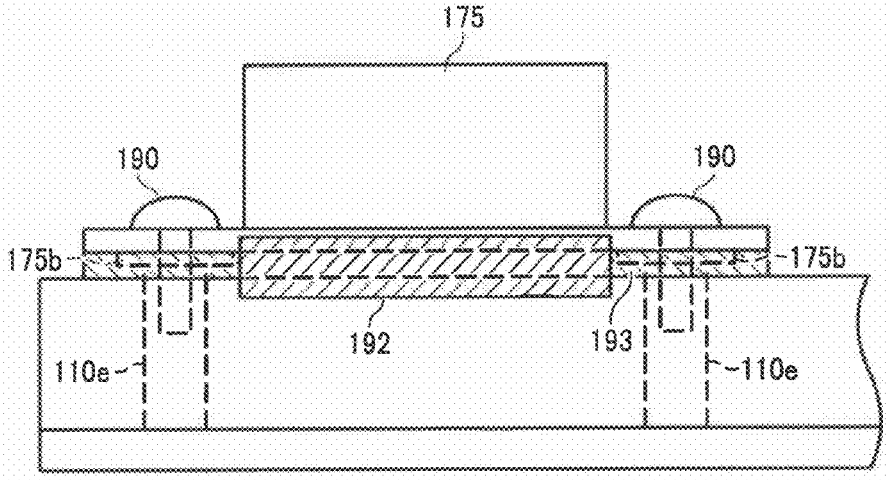
FIGS. 23A and 23B are diagrams showing the holding member installed in the belt device shown in FIG. 22.
Figure 23B:
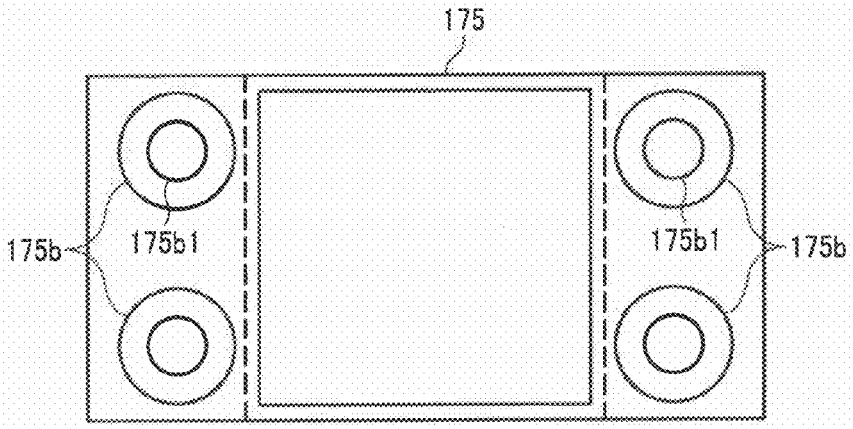

A third embodiment of the present invention is now explained in detail using FIGS. 22, 23A, and 23B. FIG. 22 is an outline perspective view showing the essential parts of the intermediate transfer belt device 15 according to the third embodiment and is an outline perspective view showing a situation where the holding cover 175 is installed to the rear frame 110. FIG. 23A is a plane view showing the holding cover 175 installed in the intermediate transfer belt device 15. FIG. 23B is the holding cover 175 as viewed from below FIG. 23A. The intermediate transfer belt device 15 of the third embodiment has the holding cover 175 disposed at the main frame 110*a* of the rear frame 110.

The intermediate transfer belt device 15 of the third embodiment has the same configuration as that of the second embodiment. In the intermediate transfer belt device 15 of the third embodiment, the holding cover 175 (holding member) is installed so as to be freely attachable/detachable with respect to the main frame 110*a* of the rear frame 110. Referring to FIG. 22, FIGS. 23A and 23B, four studs 110*e* formed with female threads for screw-fastening the holding cover 175 are fixed at the main frame 110*a*. On the other hand, four boss sections 175*b* (projecting to the side of the studs 100*e*) abutting with facets of the studs 110*e* are formed at the holding cover 175. Holes 175*b*1 that screws 190 that screw into the female threads of the studs 110*e* pass through are formed at the boss sections 175*b*. The positioning stud 110*d* taken as a positioning member for positioning with the image forming apparatus body 100 is also disposed at the main frame 110*a* of the rear frame 110. Specifically, the positioning stud 110*d* of the rear frame 110 engages with a hole (not shown) formed in the casing of the image forming apparatus body 100 so as to position the intermediate transfer belt device 15 with respect to the image forming apparatus body 100.

Here, the positioning stud 110*d* of the rear frame 110 is designed so that the positional relationship with the front frame 115 is highly precise. Parts (for example, various roller members etc.) where the relative positional relationship with the front frame 115 is important are then set so that the position is decided by the front frame 115 and the main frame 110*a*. With regards to this, the sub-frame 110*b* is not designed so as to have a function strongly supporting the main frame 110*a* so as to give a highly precise positional relationship with the front frame 115. The positional relationship of the holding cover 175 with respect to the front frame 115 can then be made highly precise by installing the holding cover 175 at the main frame 110*a* via the studs 110*e*. The drive roller 12A is then installed highly precisely at the intermediate transfer belt device 15.

In the third embodiment, the holding cover 175 is installed at the main frame 110*a* as a result of the four boss sections 175*b* abutting with the facets of the studs 110*e* of the main frame 110*a*. It is therefore possible to position the holding cover 175 with high-precision with respect to the main frame 110*a* without setting overall flatness over a broad range of an opposing surface of the holding cover 175 with a high degree of accuracy, by setting just the flatness of the four boss sections 175*b* of the holding cover 175 in a highly precise manner. The yield for the holding cover 175 is therefore increased and the cost of parts lowered.

In the third embodiment, a seal plate 192 and a sponge seal 193 are disposed as a seal member between the holding cover 175 and the rear frame 110.

Specifically, the seal plate 192 taken as a seal member is formed using flexible material such as Mylar and is affixed to either the holding cover 175 or the rear frame 110 using double-sided tape. This prevents suspended matter such as toner from encroaching to between the holding cover 175 and the rear frame 110 from above. Further, the sponge seal 193 taken as a seal member is a rectangular toroidal resilient member formed of polyurethane foam etc. affixed to the outer peripheral surface of the surface facing the holding cover 175 facing the rear frame 110. The sponge seal 193 prevents foreign matter such as toner from encroaching between the holding cover 175 and the rear frame 110.

In the third embodiment, as in each of the other embodiments, the front frame 115 having a projecting surface smaller than the inner periphery of the intermediate transfer belt 8 (belt member) as viewed from the front is cantilever-supported with respect to the rear frame 110. Mechanical strength with respect to force applied to the intermediate transfer belt device 15 (belt device) when the image forming apparatus body 100 is pulled out is therefore effectively increased. It is therefore possible to improve ease of maintenance of the intermediate transfer belt device 15 including changing of the intermediate transfer belt 8 without deformation of the intermediate transfer belt device 15.

The present invention is also applicable to a belt device using a transfer belt (an endless belt-shaped transfer member functioning in the same way as the secondary transfer roller in this embodiment) as a belt member.

In the above-explained embodiments, the present invention is applied to the intermediate transfer belt 8. However, the present invention is also applicable to a transfer belt. The present invention is also applicable to a photosensitive belt.

The present invention is not limited to the above-explained embodiments and it is clear that appropriate modifications of the embodiments are possible other than suggested here while remaining within the scope of the technical concept of the present invention. The number, position, and shape etc. of the members of the configuration are not limited to these embodiments and a preferred number, position, and shape etc. can be adopted in implementing the present invention.

The present invention thus provides a belt device and an image forming apparatus where a front frame having a projecting surface smaller than an inner periphery of the belt member as viewed from the front is cantilever-supported with respect to a rear frame. Strength with respect to force applied to the belt device when pulled out from the image forming apparatus body is therefore effectively increased. Ease of maintenance of the device including changing of the belt member is therefore increased without deformation occurring at the device.

A seal member is disposed between the holding member and the rear frame. The holding member is made from aluminum. The sub-bearing is formed of a low friction material. The image forming apparatus includes a fixing member that fixes the frame to the body in a state where the belt device is housed in the body is disposed in a freely detachable manner.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A belt device for use in an image forming apparatus such that the belt device can be pulled out to the front with respect to a body of the image forming apparatus, the belt device comprising:

an endless belt member supported at a plurality of roller members so as to travel in a predetermined direction;

two side frames disposed along sides of the belt member in the direction of travel of the belt member, the side frames being respectively slidably supported at two slide rails disposed at the body;

a rear frame constructed to the rear across the two side frames, rotatably supporting shafts of the roller members at the rear side, and having a box-type structure;

a front frame rotatably supporting shafts of the roller members on the front side, and having a projecting surface smaller than an inner periphery of the belt member when viewed from the front;

a support frame cantilever-supporting the front frame with respect to the rear frame; and triangular reinforcing members constructed across both the side frames and the rear frame near joints of the side frames and the rear frame.

2. The belt device according to claim 1, wherein the reinforcing members are disposed with a clearance of 20 millimeters or more in a vertical direction with respect to the belt member.

3. The belt device according to claim 1, wherein the side frames are disposed with a clearance of 35 millimeters or more in a lateral direction with respect to the belt member.

4. The belt device according to claim 1, wherein the support frame is formed in the shape of a box.

5. The belt device according to claim 1, wherein the slide rails are constructed to enable the belt device to be pulled out in two stages.

6. An image forming apparatus comprising the belt device disclosed in claim 1 and the body.

* * * * *